US008712267B2

(12) United States Patent
Sugimoto et al.

(10) Patent No.: US 8,712,267 B2
(45) Date of Patent: Apr. 29, 2014

(54) IMAGE FORMING APPARATUS AND IMAGE FORMING METHOD

(75) Inventors: Naomi Sugimoto, Kanagawa (JP); Shinya Tanaka, Kanagawa (JP); Haruo Iimura, Kanagawa (JP); Shinji Aoki, Kanagawa (JP); Yasuhiko Ogino, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 186 days.

(21) Appl. No.: 13/412,244

(22) Filed: Mar. 5, 2012

(65) Prior Publication Data

US 2012/0237234 A1 Sep. 20, 2012

(30) Foreign Application Priority Data

Mar. 18, 2011 (JP) ..... 2011-061678
Apr. 25, 2011 (JP) ..... 2011-097487

(51) Int. Cl.
*G03G 15/16* (2006.01)

(52) U.S. Cl.
CPC ..... *G03G 15/1675* (2013.01)
USPC ..... 399/66

(58) Field of Classification Search
CPC ..... G03G 15/1605; G03G 15/1675; G03G 2215/1614
USPC ..... 399/66, 314
See application file for complete search history.

(56) References Cited

U.S. PATENT DOCUMENTS

| | | | |
|---|---|---|---|
| 5,260,754 | A | 11/1993 | Yano et al. |
| 5,386,274 | A | 1/1995 | Sanpe et al. |
| 5,526,100 | A | 6/1996 | Misago et al. |
| 5,585,896 | A | 12/1996 | Yamazaki et al. |
| 5,592,267 | A | 1/1997 | Misago et al. |
| 5,595,852 | A | 1/1997 | Shimoda et al. |
| 5,678,129 | A | 10/1997 | Yasuda et al. |
| 5,749,022 | A | 5/1998 | Kikui et al. |
| 6,284,424 | B1 | 9/2001 | Iimura et al. |
| 6,757,511 | B2 | 6/2004 | Sugimoto et al. |
| 6,799,012 | B2 | 9/2004 | Shakuto et al. |
| 6,823,163 | B2 | 11/2004 | Sugimoto et al. |

(Continued)

FOREIGN PATENT DOCUMENTS

| | | |
|---|---|---|
| JP | 6-3913 | 1/1994 |
| JP | 8-106211 | 4/1996 |

(Continued)

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus includes an image carrier to carry a toner image, a transfer member to form a transfer nip by contacting the image carrier surface, and a power supply to output a voltage to the recording material captured in the transfer nip so as to transfer the toner image formed on the image carrier surface. The voltage is switching alternately between a voltage in the transfer direction and a voltage opposite to the voltage in the transfer direction, and a time average value (Vave) of the voltage is set to have a polarity of the transfer direction, and is set to a value in the transfer voltage side, and a change mode to change a cycle of the voltage output from the power supply can be changed based on the toner deterioration information which determines the deterioration status of the toner.

14 Claims, 29 Drawing Sheets

(56) References Cited

U.S. PATENT DOCUMENTS

| | | | | |
|---|---|---|---|---|
| 6,987,944 | B2 | 1/2006 | Shakuto et al. | |
| 7,561,835 | B2 | 7/2009 | Tanaka et al. | |
| 7,653,339 | B2 | 1/2010 | Yamashita et al. | |
| 7,662,530 | B2 | 2/2010 | Iimura | |
| 7,715,760 | B2 | 5/2010 | Sugimoto et al. | |
| 7,720,418 | B2 | 5/2010 | Tanaka et al. | |
| 7,728,503 | B2 | 6/2010 | Ohta et al. | |
| 7,738,819 | B2 | 6/2010 | Honda et al. | |
| 7,809,321 | B2 | 10/2010 | Yano et al. | |
| 7,817,954 | B2 | 10/2010 | Yano et al. | |
| 7,831,177 | B2 | 11/2010 | Someya et al. | |
| 7,873,298 | B2 | 1/2011 | Yamashita et al. | |
| 7,903,995 | B2 | 3/2011 | Nakamatsu et al. | |
| 7,929,897 | B2 | 4/2011 | Sugimoto et al. | |
| 7,941,087 | B2 | 5/2011 | Tanaka et al. | |
| 7,970,334 | B2 | 6/2011 | Yamashita et al. | |
| 7,979,017 | B2 | 7/2011 | Tanaka et al. | |
| 7,991,342 | B2 | 8/2011 | Kabata et al. | |
| 8,019,268 | B2 | 9/2011 | Nakamatsu et al. | |
| 8,041,276 | B2 | 10/2011 | Ogino | |
| 8,041,281 | B2 | 10/2011 | Sugimoto et al. | |
| 8,045,875 | B2 | 10/2011 | Aoki et al. | |
| 8,080,096 | B2 | 12/2011 | Yamashita et al. | |
| 8,081,916 | B2 | 12/2011 | Tanaka et al. | |
| 8,081,917 | B2 | 12/2011 | Nakai et al. | |
| 8,086,141 | B2 | 12/2011 | Someya et al. | |
| 8,249,474 | B2 * | 8/2012 | Wada | 399/49 |
| 8,488,985 | B2 * | 7/2013 | Miura | 399/66 |
| 2007/0025749 | A1 * | 2/2007 | Kubota | 399/66 |
| 2007/0178398 | A1 | 8/2007 | Ogino et al. | |
| 2007/0212139 | A1 | 9/2007 | Sugiura et al. | |
| 2008/0187857 | A1 | 8/2008 | Ogino et al. | |
| 2008/0310897 | A1 | 12/2008 | Naruse et al. | |
| 2009/0035038 | A1 | 2/2009 | Sugimoto et al. | |
| 2009/0142087 | A1 | 6/2009 | Iimura | |
| 2009/0304423 | A1 | 12/2009 | Ozaki et al. | |
| 2009/0311004 | A1 | 12/2009 | Naruse et al. | |
| 2010/0008706 | A1 | 1/2010 | Sugiura et al. | |
| 2010/0034560 | A1 | 2/2010 | Tanaka et al. | |
| 2010/0054829 | A1 | 3/2010 | Iio et al. | |
| 2010/0098446 | A1 | 4/2010 | Ishikawa et al. | |
| 2010/0183972 | A1 | 7/2010 | Hasegawa et al. | |
| 2010/0209143 | A1 | 8/2010 | Nakai et al. | |
| 2010/0232820 | A1 | 9/2010 | Usami et al. | |
| 2010/0239302 | A1 | 9/2010 | Naruse et al. | |
| 2010/0239309 | A1 | 9/2010 | Tanaka et al. | |
| 2010/0284705 | A1 | 11/2010 | Aoki et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0058831 | A1 | 3/2011 | Usami et al. | |
| 2011/0085834 | A1 | 4/2011 | Naruse et al. | |
| 2011/0103822 | A1 | 5/2011 | Sugiura et al. | |
| 2011/0158677 | A1 | 6/2011 | Kikuchi et al. | |
| 2011/0200348 | A1 | 8/2011 | Aoki | |
| 2011/0229168 | A1 | 9/2011 | Shiraishi et al. | |
| 2011/0229187 | A1 | 9/2011 | Hozumi et al. | |
| 2011/0229234 | A1 | 9/2011 | Hozumi et al. | |
| 2011/0255892 | A1 | 10/2011 | Aoki | |
| 2012/0008973 | A1 | 1/2012 | Sakakibara et al. | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |

FOREIGN PATENT DOCUMENTS

| | | |
|---|---|---|
| JP | 8-227201 | 9/1996 |
| JP | 2004-240369 | 8/2004 |
| JP | 2004-258397 | 9/2004 |
| JP | 2005-24634 | 1/2005 |
| JP | 2005-62858 | 3/2005 |
| JP | 2006-251409 | 9/2006 |
| JP | 2006-267486 | 10/2006 |
| JP | 2007-304316 | 11/2007 |
| JP | 2007-304492 | 11/2007 |
| JP | 2008-58585 | 3/2008 |
| JP | 2010-72580 | 4/2010 |
| JP | 2010-281907 | 12/2010 |

* cited by examiner

FIG. 33

RESULT OF COMPARATIVE EXAMPLE 1

SINE WAVE

RETURN TIME 50%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | | | | | |
| -6.6 | | | | | | |
| -6.4 | | | | | | |
| -6.2 | | | | | | |
| -6.0 | | | | | | |
| -5.8 | | | | | | |
| -5.6 | | | | | | |
| -5.4 | D | D | D | D | | |
| -5.2 | D | D | D | D | | |
| -5.0 | D | C | D | D | | |
| -4.8 | D | C | C | D | | |
| -4.6 | C | B | C | D | | |
| -4.4 | D | C | C | D | | |
| -4.2 | D | D | D | D | | |
| -4.0 | | | | | | |

THIN AT RECESSED PORTION

WHITE SPOT

THIN AT PLAIN PORTION

FIG. 34

RESULTS OF EMBODIMENTS 1-2

TRAPEZOIDAL WAVE - TRAPEZOIDAL WAVE

RETURN TIME 40%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | | | | | |
| -6.6 | | | | | | |
| -6.4 | | | | | | |
| -6.2 | D | D | D | D | | |
| -6.0 | D | D | C | D | | |
| -5.8 | D | C | B | D | | |
| -5.6 | C | C | B | C | D | |
| -5.4 | C | B | B | C | C | D |
| -5.2 | B | B | B | C | C | D |
| -5.0 | C | B | B | B | C | D |
| -4.8 | C | B | B | B | C | D |
| -4.6 | C | B | B | B | C | D |
| -4.4 | C | C | C | C | C | D |
| -4.2 | D | D | D | D | D | D |
| -4.0 | | | | | | |

THIN AT RECESSED PORTION

WHITE SPOT

THIN AT PLAIN PORTION

FIG. 35

RESULT OF EMBODIMENT 4

TRAPEZOIDAL WAVE – TRAPEZOIDAL WAVE

RETURN TIME 45%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | | | |
| −6.8 | | | | | | |
| −6.6 | | | | | | |
| −6.4 | | | | | | |
| −6.2 | | | | | | |
| −6.0 | | | D | | | |
| −5.8 | | | D | D | | |
| −5.6 | D | D | C | D | D | |
| −5.4 | D | C | B | C | C | |
| −5.2 | D | B | B | C | C | |
| −5.0 | D | B | B | B | C | D |
| −4.8 | C | B | B | B | C | D |
| −4.6 | C | B | B | B | B | D |
| −4.4 | D | C | C | C | C | D |
| −4.2 | D | D | D | D | D | D |
| −4.0 | | | | | | |

THIN AT RECESSED PORTION

WHITE SPOT

THIN AT PLAIN PORTION

FIG. 36

RESULT OF EMBODIMENT 5

TRAPEZOIDAL WAVE - TRAPEZOIDAL WAVE

RETURN TIME 40%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | | | | | |
| -6.6 | | | | | | |
| -6.4 | | | | | | |
| -6.2 | D | D | D | D | | |
| -6.0 | D | D | C | D | | |
| -5.8 | D | C | B | D | | |
| -5.6 | C | B | B | C | D | |
| -5.4 | C | B | B | C | C | D |
| -5.2 | B | B | B | B | C | D |
| -5.0 | C | B | B | B | C | D |
| -4.8 | C | B | B | B | C | D |
| -4.6 | C | B | B | B | B | D |
| -4.4 | C | C | C | C | C | D |
| -4.2 | D | D | D | D | D | D |
| -4.0 | | | | | | |

THIN AT RECESSED PORTION

WHITE SPOT

THIN AT PLAIN PORTION

FIG. 37

RESULT OF EMBODIMENT 6

TRIANGULAR WAVE - TRAPEZOIDAL WAVE

RETURN TIME 32%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | D | D | D | | |
| -6.6 | D | D | C | D | D | |
| [illegible] | D | D | C | C | D | |
| [illegible] | D | C | B | B | D | D |
| -6.0 | C | B | B | B | C | D |
| -5.8 | C | B | B | B | C | D |
| -5.6 | C | B | B | B | C | D |
| -5.4 | B | B | B | B | C | D |
| -5.2 | B | B | B | B | B | D |
| -5.0 | C | B | B | B | B | D |
| -4.8 | C | B | B | B | B | C |
| -4.6 | C | B | B | B | B | C |
| -4.4 | C | C | C | C | C | D |
| -4.2 | D | D | D | D | D | D |
| -4.0 | | | | | | |

THIN AT RECESSED PORTION

WHITE SPOT

THIN AT PLAIN PORTION

FIG. 38

RESULT OF EMBODIMENT 7

TRIANGULAR WAVE - TRAPEZOIDAL WAVE

RETURN TIME 16%

| Vave \ Vpp | 8 | 10 | 12 | 14 | 16 | 18 |
|---|---|---|---|---|---|---|
| -7.6 | | | | | | |
| -7.4 | | | D | D | | |
| -7.2 | | D | C | C | | |
| -7.0 | | D | C | B | | |
| [illegible] | | C | B | B | | |
| [illegible] | D | C | B | B | D | |
| -6.4 | C | B | B | B | D | |
| -6.2 | C | B | B | B | D | D |
| -6.0 | B | B | B | B | C | D |
| -5.8 | B | B | B | B | C | D |
| -5.6 | B | B | B | B | C | D |
| -5.4 | B | B | B | B | B | D |
| -5.2 | B | B | B | B | B | C |
| -5.0 | C | B | B | B | B | C |
| -4.8 | C | B | B | B | B | C |
| -4.6 | C | B | B | B | B | C |
| -4.4 | C | C | C | C | C | D |
| -4.2 | D | D | D | D | D | D |
| -4.0 | | | | | | |

THIN AT RECESSED PORTION

WHITE SPOT

THIN AT PLAIN PORTION

FIG. 39

RESULT OF EMBODIMENT 8

TRIANGULAR WAVE – TRAPEZOIDAL WAVE

RETURN TIME 8%

| Vave \ Vpp | 8 | 10 | 12 | 14 | 16 | 18 |
|---|---|---|---|---|---|---|
| −7.6 | | | | C | | |
| −7.4 | | | D | C | | |
| [illegible] | | D | C | B | | |
| [illegible] | | D | B | B | | |
| −6.8 | | C | B | B | D | |
| −6.6 | D | C | B | B | D | |
| −6.4 | C | B | B | B | C | |
| −6.2 | C | B | B | B | C | D |
| −6.0 | B | B | B | B | C | D |
| −5.8 | B | B | B | B | B | C |
| −5.6 | B | B | B | B | B | C |
| −5.4 | B | B | B | B | B | C |
| −5.2 | B | B | B | B | B | C |
| −5.0 | C | B | B | B | B | C |
| −4.8 | C | B | B | B | B | C |
| −4.6 | C | B | B | B | B | C |
| −4.4 | C | C | C | C | C | D |
| −4.2 | D | D | D | D | D | D |
| −4.0 | | | | | | |

THIN AT RECESSED PORTION

WHITE SPOT

THIN AT PLAIN PORTION

FIG. 40

RESULT OF EMBODIMENT 9

TRIANGULAR WAVE - TRAPEZOIDAL WAVE

RETURN TIME 4%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | | | | | |
| -6.6 | | | D | D | | |
| -6.4 | | | D | C | | |
| -6.2 | | | D | C | D | |
| -6.0 | | | C | B | C | |
| [illegible] | | D | C | B | C | |
| [illegible] | | D | B | B | C | D |
| -5.4 | | C | B | B | B | D |
| -5.2 | | C | B | B | B | C |
| -5.0 | D | B | B | B | B | C |
| -4.8 | C | B | B | B | B | C |
| -4.6 | C | B | B | B | B | C |
| -4.4 | C | C | C | C | C | D |
| -4.2 | D | D | D | D | D | D |
| -4.0 | | | | | | |

WHITE SPOT

THIN AT RECESSED PORTION

THIN AT PLAIN PORTION

FIG. 41

RESULT OF EMBODIMENT 10

TRIANGULAR WAVE - ROUNDED TRAPEZOIDAL WAVE

RETURN TIME 16%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | D | | |
| -6.8 | | D | D | C | | |
| -6.6 | D | D | C | C | D | |
| [illegible] | D | D | C | B | D | |
| [illegible] | D | C | B | B | D | |
| -6.0 | C | B | B | B | D | |
| -5.8 | C | B | B | B | C | D |
| -5.6 | B | B | B | B | C | D |
| -5.4 | B | B | B | B | C | D |
| -5.2 | B | B | B | B | B | D |
| -5.0 | C | B | B | B | B | D |
| -4.8 | C | B | B | B | B | C |
| -4.6 | C | B | B | B | B | C |
| -4.4 | C | C | C | C | C | D |
| -4.2 | D | D | D | D | D | D |
| -4.0 | | | | | | |

THIN AT RECESSED PORTION

WHITE SPOT

THIN AT PLAIN PORTION

IMAGE FORMING APPARATUS AND IMAGE FORMING METHOD

CROSS-REFERENCE TO RELATED APPLICATIONS

This patent application is based on and claims priority pursuant to 35 U.S.C. §119 to Japanese Patent Applications Nos. 2011-061678, filed on Mar. 18, 2011, and 2011-097487, filed on Apr. 25, 2011, in the Japanese Patent Office, the entire disclosures of which are hereby incorporated by reference herein.

BACKGROUND OF THE INVENTION

1. Field of the Invention

The present invention relates to an image forming apparatus, such a copier, printer, facsimile machine, and multifunctional machines combining the functions of these apparatuses, and an image forming method.

2. Description of the Related Art

Conventionally, various image forming methods employing electrophotography are known, in which the surface of the latent image carrier is charged and the charged surface of the latent image carrier is exposed to form an electrostatic latent image. Then, the electrostatic latent image is developed with toner to form a toner image on the latent image carrier. The toner image is transferred onto a recording media such as paper, etc., either directly or through an intermediate transfer member that acts as an image carrier. The transferred toner image is fixed in place on the medium by heat and pressure by a fixing device, whereby an image is formed on the recording media. Any toner then remaining on the latent image carrier and/or the image carrier after the toner image transfer is cleaned by known cleaning means, for example, blades, brushes, rollers, etc.

If there are irregularities on the recording media on which the image is formed, the protruding portions come into contact with the toner on the intermediate transfer member or on the latent image carrier during the toner transfer process. However, in the recess portion, gaps are formed between the toner on the intermediate transfer member or the latent image carrier and the bottom of the recess of the recording media. The gaps reduce a transfer electric field acting on the toner, and accordingly, the transfer electric field in the recess portions are reduced compared to that in the protruding portion, resulting in unevenness of the transferred image. As the degree of roughness of the recording media increases, the transfer electric field in the recessed portions are reduced significantly, making it difficult to transfer the toner at the recess portion and resulting in streaks in the finished image where no toner image is adhered to the medium.

Furthermore, when the toner has remained in the image forming apparatus for a long time without being consumed for forming a toner image, the toner deteriorates: for example, the toner chargeability changes, or the fluidity is degraded because the external additives attached to the surface of the toner are buried or separated. In the normal transfer process using a DC voltage, the transfer performance of transferring the toner onto uneven recording material is unsatisfactory even with toner that has not deteriorated, however, transfer performance is significantly lowered when the toner is deteriorated.

Therefore, there is a unsolved need for an image forming apparatus that can achieve sufficient image density both at the recessed portions and the protruding portions of the surface of the recording material while reducing the occurrence of white spots, and improving transfer performance to the recording media having unevenness even if the toner is deteriorated, thereby obtaining high quality images without unevenness and white spots or streaks.

SUMMARY OF THE INVENTION

The present invention describes a novel image forming apparatus. In one example, a novel image forming apparatus includes a rotatable image carrier configured to carry a toner image developed with toner on a surface of the image carrier, a rotatable transfer member configured to form a transfer nip by contacting the image carrier surface, and a power supply configured to output a voltage to transfer the toner image formed on the image carrier surface to a recording material captured in the transfer nip. The voltage is switched alternately between a voltage in the transfer direction to transfer the toner image from the image carrier to the recording material and a voltage opposite to the voltage in the transfer direction when the toner image formed on the image carrier surface is transferred to the recording material. A time average value (Vave) of the voltage has a polarity of the transfer direction to transfer the toner image from the image carrier to the recording material and is set to a value closer to the transfer voltage side. The image forming apparatus has a mode to change a cycle of the voltage output from the power supply based on toner information indicating a state of deterioration of the toner.

The cycle of the voltage when the toner information is present may be set to a larger value than that when the toner information is not present.

The cycle of the voltage may be changed by changing a frequency of the voltage output from the power supply.

The cycle of the voltage may be changed by changing a processing linear velocity of the image forming apparatus.

When an output time of the voltage area in the transfer direction for the center voltage Voff is defined as "A", and an output time of the voltage in a direction reverse to the transfer direction for the center voltage Voff is defined as "B", it may be set as A>B.

A time t1 of moving from the center voltage Voff to the peak voltage in the transfer direction may be greater than a time moving from a peak voltage of a polarity opposite to the peak voltage in the transfer direction to the center voltage Voff.

The voltage may be set to satisfy the relation $0.05<X<0.45$, where the voltage is X, and $X=B/(A+B)$.

The voltage may be set to satisfy the relation $0.10<X<0.40$, where the voltage is $X=B/(A+B)$.

The power supply may be configured to output a voltage by superimposing an AC component on a DC component, and the DC component is subjected to constant current control.

The present invention further describes a novel image forming apparatus. In one example, a novel image forming apparatus includes a rotatable image carrier configured to carry a toner image developed with toner on a surface of the image carrier surface, a rotatable transfer member configured to form a transfer nip by contacting the image carrier surface, a power supply configured to output a voltage to the recording material captured in the transfer nip to transfer the toner image formed on the image carrier surface, and a toner status determination unit configured to determine whether or not the toner is deteriorated and output toner information including that the toner is deteriorated when the toner status determination unit determines that the toner is deteriorated. The voltage switches alternately between a voltage in the transfer direction to transfer the toner image from the image carrier and a voltage opposite to the voltage in the transfer direction when the toner image formed on the image carrier surface is transferred to the recording material. A time average value (Vave) of the voltage has a polarity of the transfer direction to transfer the toner image from the image carrier to the recording material and is set to a value closer to the transfer voltage side from an intermediate value (Voff) between maximum and minimum values. A cycle of the voltage output from the power supply can be changed based on the toner information from the toner status determination unit.

The toner status determination unit may detect an image density of the toner image and determine that the toner is deteriorated when the detected value is below a predetermined threshold value.

The above-described image forming apparatus may further include a latent image carrier configured to form a latent image, an image forming unit configured to form a toner image on the latent image carrier, and a primary transfer unit configured to transfer the toner image on the latent image carrier to the latent image carrier. The toner status determination unit may detect a transfer rate by the primary transfer unit and determine whether or not the toner is deteriorated based on a change of the transfer rate.

The present invention further describes a novel image forming method. In one example, a novel method of controlling an image forming apparatus having a power supply includes developing a toner image on a surface of a rotatable image carrier with toner, forming a transfer nip by contacting a rotatable transfer member against the image carrier surface, supplying recording material to the transfer nip, outputting a voltage from the power supply to the recording material captured in the transfer nip to transfer the toner image formed on the image carrier surface to the recording material, and changing a cycle of the voltage output from the power supply changed based on toner information indicating the state of deterioration of the toner. The voltage alternates between a voltage in the transfer direction to transfer the toner image from the image carrier and a voltage opposite to the voltage in the transfer direction when the toner image formed on the image carrier surface is transferred to the recording material. A time average value (Vave) of the voltage has a polarity of a transfer direction to transfer the toner image from the image carrier to the recording material and is set to a value closer to the transfer voltage side.

The method may further include determining whether or not the toner is deteriorated, and outputting toner information including that the toner is deteriorated when the determining step determines that the toner is deteriorated.

BRIEF DESCRIPTION OF THE DRAWINGS

A more complete appreciation of the disclosure and many of the attendant advantages thereof will be more readily obtained as the same becomes better understood by reference to the following detailed description when considered in conjunction with the accompanying drawings, wherein:

FIG. 33 is a graph showing the effect of the comparative example 1, and results of an evaluation of an image on a recording material with a return time of 50%;

FIG. 34 is a graph showing the effect of the embodiments 1 and 2, and the evaluation result of an image on a recording material with a return time of 40%;

FIG. 35 is a graph showing the effect of the embodiment 4, and results of an evaluation of an image on a recording material with a return time of 45%;

FIG. 36 is a graph showing the effect of the embodiment 5, and results of an evaluation of an image on a recording material with a return time of 40%;

FIG. 37 is a graph showing the effect of the embodiment 6, and results of an evaluation of an image on a recording material with a return time of 32%;

FIG. 38 is a graph showing the effect of the embodiment 7, and results of an evaluation of an image on a recording material with a return time of 16%;

FIG. 39 is a graph showing the effect of the embodiment 8, and results of an evaluation of an image on a recording material with a return time of 8%;

FIG. 40 is a graph showing the effect of the embodiment 9, and results of an evaluation of an image on a recording material with a return time of 4%;

FIG. 41 is a graph showing the effect of the embodiment 10, and results of an evaluation of an image on a recording material with a return time of 16%;

DETAILED DESCRIPTION OF THE INVENTION

Referring to the figures, embodiment of the present invention will now be described. Now, this embodiment is an example, and it has been confirmed by various imaging forming environment and a plurality of image forming apparatuses that the effect of the present invention can be obtained even if the configuration and process conditions are changed.

Figure 1:
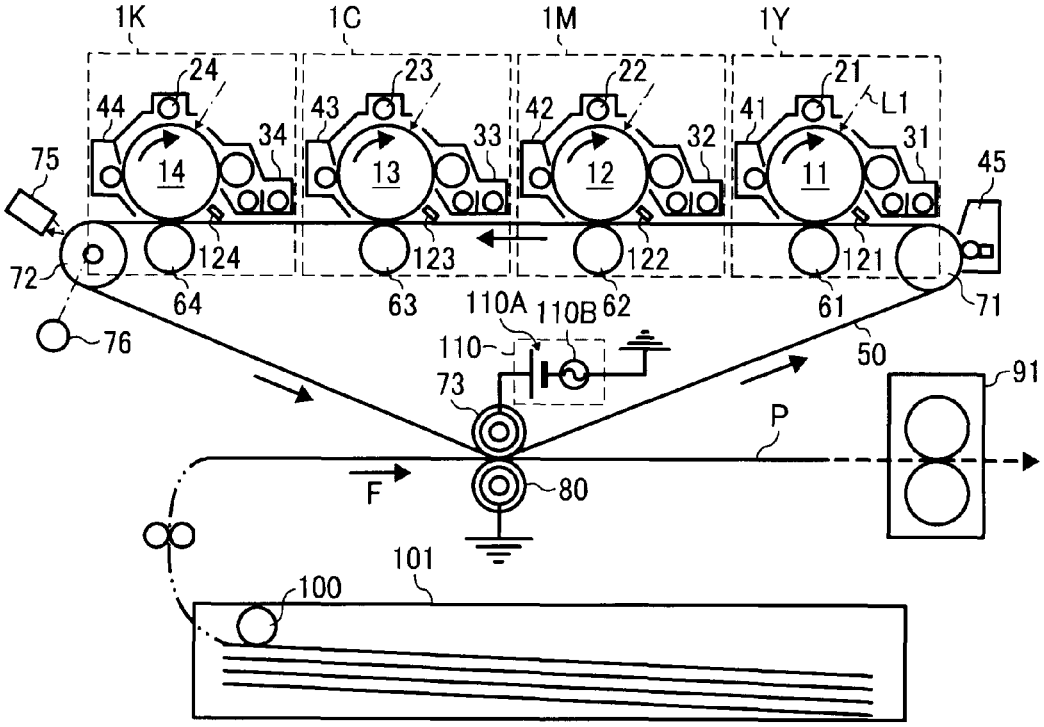
FIG. 1 is a schematic of an overall configuration of an image forming apparatus according to the present invention.
Figure 2:
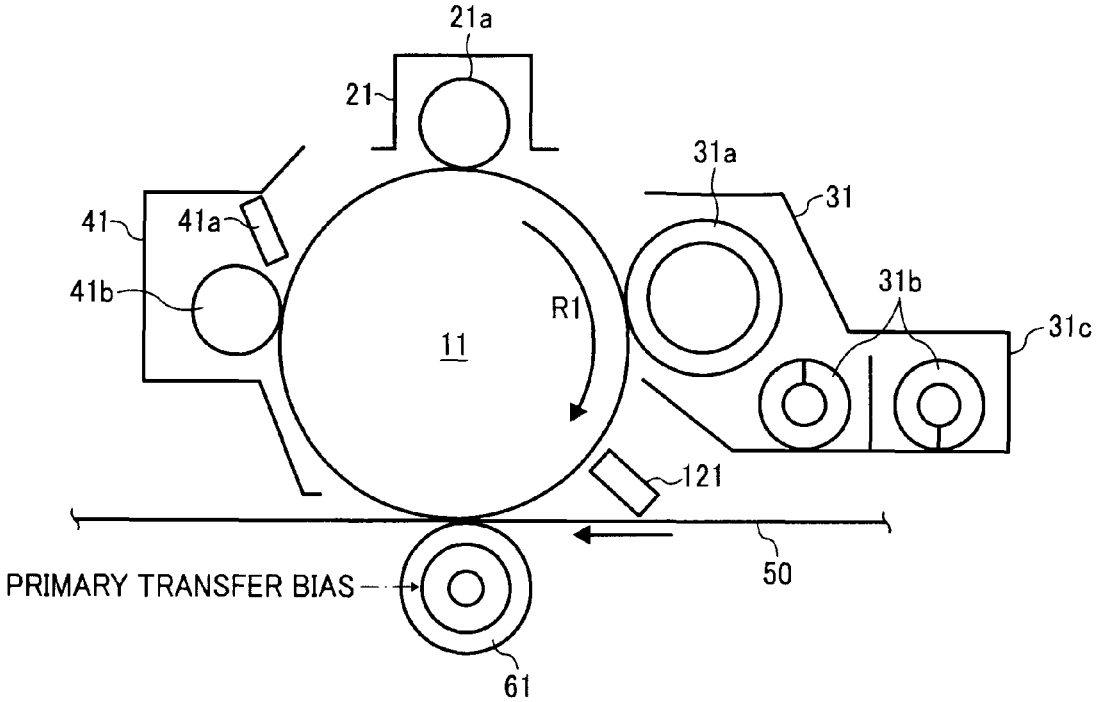
FIG. 2 is a schematic configuration of an image forming unit of the image forming apparatus according to the present invention.

FIG. 1 is a schematic diagram of an embodiment of a color image forming apparatus (hereinafter simply "printer") according to the present invention. The printer forms an image on recording paper P which is a target recording media by superimposing four color components of yellow (Y), magenta (M), cyan (C) and black (K) images thereupon.

In this embodiment, image forming units 1Y, 1M, 1C and 1K, corresponding to each color, yellow (Y), magenta (M), cyan (C) and black (K), are arranged in parallel in the direction of movement of the intermediate transfer belt 50 which is the image carrier and forms an intermediate transfer member as shown in FIG. 1.

A photosensitive drum 11, 12, 13, and 14, which forms the latent image carrier and is provided in each image forming unit 1Y, 1M, 1C and 1K, is an organic photoreceptor having an outer diameter of 60 mm, and each color toner image formed on the surface thereof is transferred sequentially to the intermediate transfer belt 50, which contacts the photosensitive drum from below. The toner image transferred onto the intermediate transfer belt 50 is transferred onto the recording sheet P fed from the paper cassette 101 through a paper feeding roller 100. More specifically, the recording paper P fed from the paper cassette 101 is conveyed to a position between the intermediate transfer belt 50 and a secondary transfer roller 80 which form the secondary transfer nip by contacting each other at a predetermined timing from a direction shown by arrow F.

The full-color toner image formed on the intermediate transfer belt 50 is transferred onto the recording paper P at the secondary transfer nip formed between the secondary transfer roller 80 and the secondary transfer facing roller 73 that is the opposing member opposed to the secondary transfer roller 80 and faces the secondary transfer roller 80 via the intermediate transfer belt 50. The recording paper P on which the full color toner image is transferred is conveyed to a fixing device 91. At the fixing device 91, the image is fixed by heat and pressure, and, is output from the printer.

Figure 8:
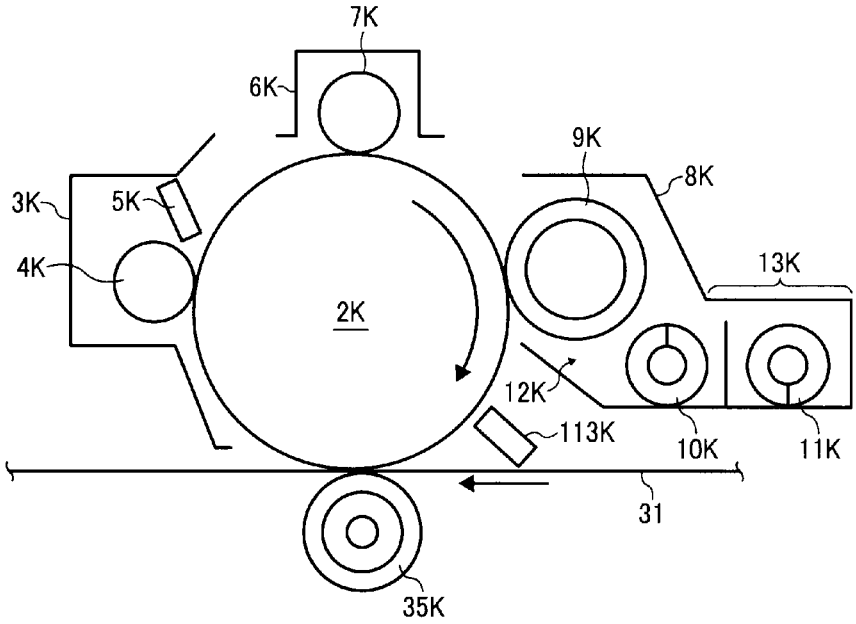
FIG. 8 is an enlarged view showing a schematic configuration of image forming units for K in the printer of FIG. 7.

Each image forming unit has the same configuration to each other. Therefore, the image forming unit 1Y is described as the typical example. FIG. 8 is a schematic diagram showing the configuration of the image forming unit 1Y according to the embodiment. The image forming unit 1Y includes a photosensitive drum 11, a charging device 21 to charge a surface of the photosensitive drum 11 by, for example, a charging roller 21*a*, a developing unit 31 which is the image forming means to form a toner image with a latent image on the photosensitive drum 11, a primary transfer roller 61 which is the primary transfer means to transfer the toner image onto the intermediate transfer belt 50, and a photoreceptor cleaning device 41 to clean the residual toner remaining on the surface of the photoconductive drum 11. An image density sensor 121 is disposed at a downstream from the developing unit 31 in the direction of rotation of the photoreceptor 11 to measure the image density of the developed toner image on the photoreceptor 11. The image forming units, 1M, 1C and 1K also include image density sensors 122, 123 and 124 to measure the image density of the developed toner image formed on the photoreceptors 12, 13 and 14, similarly.

The charging device 21 is configured to apply a voltage formed by superimposing an AC voltage on a DC voltage to the charging roller 21*a* consisting of a conductive elastic body having a roller shape. The charging device 21 charges the photosensitive drum 11 at a predetermined polarity, for example, a negative polarity by causing a direct discharge between the charging roller 21*a* and the photosensitive drum 11. Then, the charged surface of the photosensitive drum 11 is irradiated by a modulated laser beam L emitted from an image writing unit, not shown, to form an electrostatic latent image on the surface of the photosensitive drum 11. More specifically, portions irradiated by the laser experience a decrease in the absolute value of the potential at the surface area of the photoreceptor that become the electrostatic latent image (image area), while portions not irradiated maintain the absolute value of the potential at the surface area of the photoreceptor and become the bare (non-imaged) area. The primary transfer roller 61 is an elastic roller having a conductive sponge layer, and disposed to be pressed against the photosensitive drum 11 from the back side of the intermediate transfer belt 50. A bias voltage controlled using constant current control is applied to the primary transfer roller 61 as a primary transfer bias.

The outer diameter of the primary transfer roller 61 is 16 mm, and the diameter of the metal core is 10 mm. The resistance R of the sponge layer is about 3 E10Ω, calculated using Ohm's law (R=V/I). The current I that flows when a voltage V of 1000 V is applied to the metal core of the primary transfer roller 61 while being pressed by a metal roller having an outer diameter of 30 mm and is grounded.

The photoreceptor cleaning device 41 includes a cleaning blade 41*a* and a cleaning brush 41*b*. The cleaning blade 41*a* contacts the surface of the photosensitive drum 11 from a direction counter to the direction of rotation of the photosensitive drum 11. The cleaning brush 41*b* is contacting the surface of the photosensitive drum 11 while rotating in the direction opposite to the direction of rotation of the photosensitive drum 11 to clean the surface of the photosensitive drum 11.

The developing unit 31 includes a storage container 31*c* that contains the two-component developer having a Y toner and a carrier, a developing sleeve 31 disposed in the storage container 31*c* to face the photosensitive drum 11 through the opening of the storage container 31*c*, and two screw members 31*b* disposed in the storage container 31*c* to work as the agitation member so as to convey and stir the developer. The screw members 31*b* are disposed at the supply side of the developer that is the developing sleeve side and the receive side to receive a supply developer from the toner replenishment equipment (not shown), respectively, and are supported rotatably with bearings (not shown) by the storage container 31*c*.

The photosensitive drums 11, 12, 13 and 14 in the four image forming units are driven to rotate in the direction shown by arrow R1 in the figure by a drive device (not shown) for each of the photosensitive drums, respectively. Further, the photosensitive drum 14 for the black image may be driven to rotate independently from the photosensitive drums 11, 12, and 13 for color images. Accordingly, for example, when a monochrome image is formed, only the photosensitive drum 14 for the black image is driven to rotate, and when a color image is formed, the four photosensitive drums 11, 12, 13 and 14 can be driven to rotate at the same time. The intermediate transfer unit including an intermediate transfer belt 50 is configured to be separated from the photosensitive drums 11, 12, and 13 for color images and moved out of the way when monochrome images are formed.

Further, the intermediate transfer belt 50 has a thickness between 40 μm and 200 μm, preferably about 60 μm, and a volume resistivity of 1 E6 Ωcm to 1 E12 Ωcm, preferably about 1 E9 Ωcm (measured value by applying a voltage of 100V using Hiresta UP MCP HT450 manufactured by Mitsubishi Chemical), and is formed of endless carbon dispersion polyimide resin, and entrained around a plurality of support rollers such as the secondary transfer opposed roller 73 and the support rollers 71 and 72. The intermediate transfer belt 50 is configured to move endlessly in the direction shown by arrow in the figure by the rotation of the drive motor 76. The outer diameter of the secondary transfer opposed roller 73 is 24 mm approximately, and the diameter of the metal core is 16 mm. The metal core 16 is formed of an NBR rubber conductive layer (about 4 E7Ω as measured by the same measurement method as that for the primary transfer roller). Facing the support roller 72, an image density sensor 75 is disposed to detect the image density of the toner image on the intermediate transfer belt 50. The image density of the toner image transferred onto the intermediate transfer belt 50 is measured by the image density sensor 75 when the image passes over the support roller 72.

The transfer bias power source 110 is connected to the secondary transfer opposed roller 73, and includes a DC power supply 110A and an AC power supply 110B. By applying a voltage to the secondary transfer opposed roller 73, a potential difference between the secondary transfer opposed roller 73 and the secondary transfer roller 80 is generated to move the toner image from the intermediate transfer belt 50 to the recording sheet P. Accordingly, it is possible to transfer the toner image to the recording sheet P. The outer diameter of the secondary transfer roller 80 is 24 mm approximately, and the diameter of the metal core is 14 mm and is formed of NBR rubber conductive layer (below 1 E6) measured by the same measurement method as that used for the primary transfer roller 61).

Now in this embodiment, the potential difference can be defined by, (the potential of the opposite member)−(the potential of the transfer member).

Incidentally, the secondary transfer bias power source 110 may be connected to the secondary transfer roller 80 to apply a transfer bias so that the toner image is transferred onto the recording paper P. Further, one of the transfer bias powers 110 may be connected to the secondary transfer roller 73, and the other one of transfer bias power 110 may be connected to the secondary transfer roller 80. For example, a DC power supply 110A may be connected to the secondary transfer opposed roller 73, and an AC power supply 110B may be connected to the secondary transfer roller 80, or, the opposite configuration can be employed. In this embodiment, a sine wave is used as the waveform of the alternating voltage, however, there is no problem even when other waveform like a square wave is used. In other word, the power supply 110 forms the electric field forming means to form an alternating electric field between the image carrier and the recording media.

Figure 3:
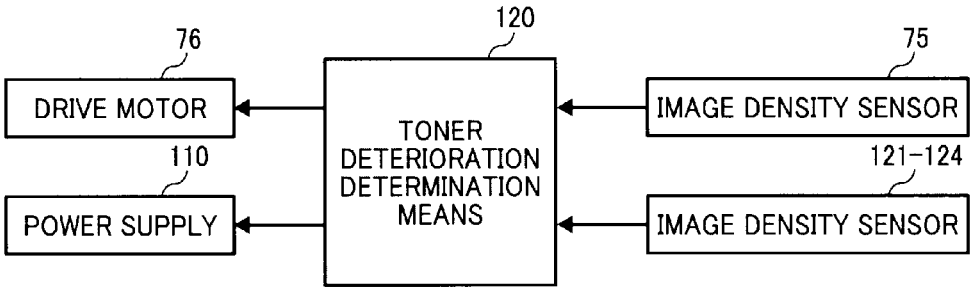
FIG. 3 is a toner status determination unit and a block diagram of a control configuration.

Referring to FIG. 3, the configuration for control system according to the present embodiment will be described.

the power supply 110, the image density sensor 75, the image density sensors 121, 122, 123 and 124, a drive motor 76 are connected to the toner deterioration determination means 120 which determines whether or not the toner is deteriorated through signal lines. The toner deterioration determination means 120 is formed of so called the computer circuit, and the toner density information measured by the image density sensors 121, 122, 123, and 124 is input thereto. Then, the deterioration state of the toner is determined from the input toner density information. Based on the determination result, it functions to change the number of periods of the alternating electric field in a secondary transfer nip N. The toner deterioration determination means 120 stores the threshold values of the criteria for determining the deterioration state and the setting values for changing the number of period of the alternating electric field.

The studies the present inventors have conducted using the present embodiment will be described below, referring to the accompanying drawings.

Figure 4:
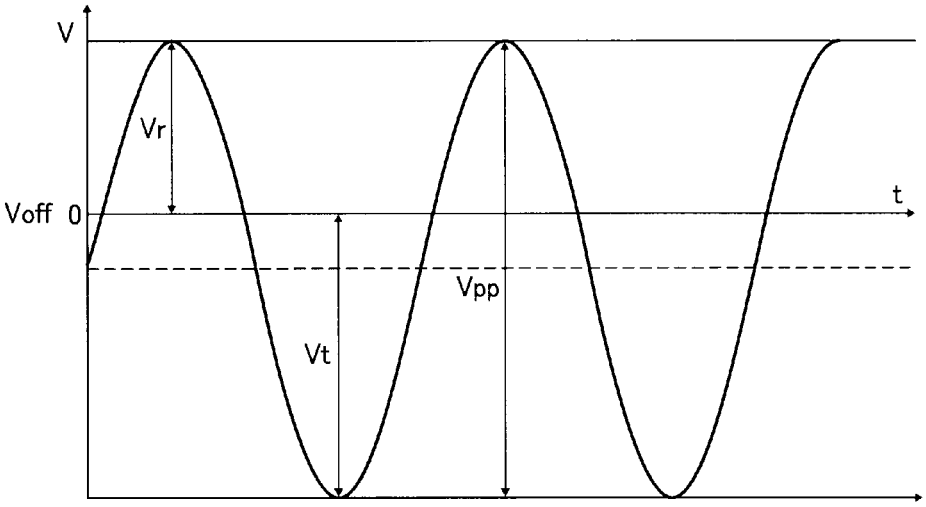
FIG. 4 is a voltage wave when a voltage formed by superimposing an AC voltage on a DC voltage is applied by an electric field forming means.

FIG. 4 is a diagram showing a voltage change in time when the voltage formed by superimposing an AC voltage on a DC voltage is applied by the power supply 110.

Voff represents the average value with time of a potential difference between the secondary transfer roller 73 and the secondary transfer roller 80 by the applied voltage (the potential of the opposite member−the potential of the transfer member). Since, the potential of the transfer member is 0V, it is the same value as the DC component applied to the secondary transfer pair roller 73 from the power supply 110. Vpp represents the voltage between the peak values of the applied voltage. Further, a peak voltage in the transfer direction in which the toner transfers from the transfer member (image carrier, or intermediate transfer body) to the recording sheet P is defined as Vt, and a peak voltage in the return direction in which the toner returns from the recording sheet P back to the intermediate transfer belt 50 is defined as Vr.

The developer used in the present embodiment is formed of a general amorphous toner having the average toner particle size of 6.8 μm (polyester) and plastic carriers having an average particle diameter of 55 μm.

When the toner image is transferred onto the recording sheet P having an uneven surface by the transfer bias formed by superimposing an AC voltage on a DC voltage, it is found that there is a condition to obtain a good image. In order to transfer the toner onto the recessed portions of the recording sheet P having an uneven surface, it required to superimpose an AC voltage of a sufficiently large voltage as shown by the equation (equation 1) below onto the time average potential of the secondary transfer opposed roller 73 for the secondary transfer roller 80 (in this embodiment, the DC component voltage applied by the power supply 110) Voff. Further, it is requested to adjust Voff and Vpp so that a discharge is not occurred at the protruding portions and the image density is not degraded at the protruding portion.

$$Vpp>4\times|Voff| \quad \text{(equation 1)}$$

When the toner image is transferred by the transfer bias formed by superimposing an AC voltage on a DC voltage, it is found that there is a condition in which the image has no periodical unevenness due to the AC voltage. More specifically, when the frequency of the alternating voltage is f[Hz], the linear velocity of the intermediate transfer belt 50 is v [mm/s], and the transfer nip width of the secondary transfer portions are d[mm], a time during which the image passes through the transfer nip is expressed by a value of the nip width divided by the linear velocity, that is, $$d/v[s].$$

Further, the period number of the alternating voltage applied while the image is passing through the nip is expressed by d×f/v, where the period of the alternating voltage is 1/f[s]. The condition which does not cause the periodic image unevenness is obtained by setting the frequency more than four times. Accordingly, the condition for the frequency f of the alternating voltage is expressed as the following equation 2, $$F>(4/d)\times v \quad \text{(equation 2)}$$

In this embodiment, an actual example which satisfies the condition above will be described below.

When the image is transferred to a recording paper as the recording paper having unevenness, for example, a FC WASHI type paper (Japanese paper) called "SAZANAMI" manufactured by NBS Ricoh Inc, which has a thickness of 130 μm and a difference of the surface unevenness is 130 μm as the maximum, it is found that a good quality image can be obtained with no white spot when it is set that the transfer bias Voff=−1.0 kV and Vpp=5.0 kV. Further, when the setting value of the linear velocity of the intermediate transfer belt 50 is 282 mm/s, no image unevenness is generated at the frequency of, for example, 400 Hz.

When a low image area rate image in which the image area occupies on the recording paper P by a percentage of lower than 5% is output continuously, both image densities in the recess and the protruding portions are gradually decreased and the white missing image is generated. When the low image area ratio images are output continuously, the toner is not consumed in the developing unit so that various stresses are given to members and units in the image forming apparatus. Accordingly, for example, additives added to the surface of the toner are buried inside the toner or, separated from the toner so that the toner is deteriorated.

Particularly when the surface of the toner is coated with additives, the intermediate transfer belt 50 contacts the external additive, however, the particle size of the external additive is very small, therefore, the contact area between the intermediate transfer belt 50 and the toner is small. By contrast, when the external additive on the surface of the toner is buried or separated, the intermediate transfer belt 50 contacts the surface of the toner, however, since the toner particle size is sufficiently large compared to the external additive, the contact area between the toner and the intermediate transfer belt 50 is large. When the contact area is large, the adhesion force between the powder and the contact surfaces increases. Accordingly, the adhesion force between the intermediate transfer belt 50 and the deteriorated toner is greater than the adhesion force between the intermediate transfer belt 50 and the normal toner which is not deteriorated. When the adhesion force is increased because of the toner deterioration, it is considered that transfer performance becomes worse because it becomes difficult that the toner separates from the intermediate transfer belt 50.

We have conducted evaluations using a various conditions with a variety of combinations of the transfer conditions of Voff and Vpp, however, the white missing image is occurred in all the conditions. Accordingly, no improvement on transfer performance has been obtained.

Next, the transfer bias is set to Voff=−1.0 kV, Vpp=5 kV, similarly to the condition described above, and transfer performance to the recessed portions of the recording material P is evaluated by changing the frequency by the steps of 200 Hz from 400 Hz to 2000 Hz.

As for the evaluation for transfer performance, the transfer image is evaluated using five steps evaluation procedure.

The rank 5 is given if the toner is transferred to the recessed portions to obtain a sufficient image density.

The rank 4 is given if the toner is slightly missing and white pattern is seen slightly in the recessed portions or, the image density at the recessed portions are reduced slightly, but acceptable as the product.

The rank 3 is given if the toner is missing to have a white missing pattern in the recessed portions compared to rank 4 or, the image density is reduced in the entire region, and not acceptable as the product.

The rank 2 is given if there are more white missing patterns are recognized in the recess portions compared to rank 3 or, the image density is low in the entire region.

The rank 1 is given if the white missing pattern is seen in the recess portions entirely, and the state of the groove is recognized clearly.

Table 1 shows the evaluation results depending on the setting value of the frequency.

TABLE 1

| | Frequency (Hz) | | | | | | | | |
|---|---|---|---|---|---|---|---|---|---|
| | 400 | 600 | 800 | 1000 | 1200 | 1400 | 1600 | 1800 | 2000 |
| Transfer performance in recess portion | 2 | 3 | 4 | 5 | 5 | 5 | 5 | 5 | 5 |

As shown in Table 1, when the frequency is increased, transfer performance in the recessed portions are improved. If the frequency is set to equal to and higher than 800 Hz, the image which is higher than rank 4 and has an acceptable level as a product can be obtained. Thus, it is found that a high transfer performance at the recessed portions can be obtained by increasing frequency of the alternating voltage even when the toner is deteriorated.

The increase in frequency is corresponding to the increase in the number of period times of the alternating voltage in the secondary transfer nip N. Based on the consideration above, it becomes clear that it is necessary to increase the number of the periods to transfer the deteriorated toner.

Now, the reason for that is discussed.

The mechanism to obtain a high transfer performance of the toner in the recessed portions by the alternating field is considered to be due to the following reason. When an alternating electric field is applied, a part of the toner on the intermediate transfer belt 50 is moved from the intermediate transfer belt 50 to the recessed portions of the recording material P by the electric field of the transfer direction to transfer the toner from the intermediate transfer belt 50 to the recessed portions of the recording material P which is the target material. The toner transferred to the recessed portions of the recording material P returns to the intermediate transfer belt 50 by the electric field of the return direction to move the toner from the recording material P to the intermediate transfer belt 50. The electric field causes interactions such as electrostatic forces, mechanical forces, for example, the transferred toner collides against or contacts the toner on the intermediate transfer belt 31. Accordingly, the toner adhesion state on the intermediate transfer belt is changed by these interactions. Then, the toner which becomes easy to separate from the intermediate transfer belt 50 is transferred to the recessed portions by the following electric field in the direction to move the toner from the recording material P to the intermediate transfer belt 50. However, the number of toner particles which is transferred to the recessed portions increases, compared to the number of toner particles transferred at the previous cycle. This makes an increase in the number of toner particles which participate the reciprocating motion when the number of the cycle of the alternating electric field increases, resulting in improvement of the toner transfer performance to the recess portion. When the adhesion force of the toner is small in the case when the toner is not deteriorated, it is easy to make the toner on the intermediate transfer belt 50 to transfer. Accordingly, the number of the toner to transfer is increased sufficiently even if the number of reciprocating motion is small. However, when the adhesion force of the toner is large in the case for the deteriorated toner, it is not easy to make the toner on the intermediate transfer belt 50 to transfer. Accordingly, it is considered that a lot of the reciprocating motion is needed until a sufficient number of the toner transfer.

As described previously, the number of the period of the alternating voltage in the transfer nip, is determined by the nip width, the linear velocity and the frequency of the alternating voltage. Therefore, as the means to increase the number of periods, there is a procedure to slow down the process linear velocity besides the frequency of the alternating voltage and the nip width which is determined by the configuration of the image forming apparatus. In fact, transfer performance is evaluated under the transfer bias condition of Voff=−1.0 kV, Vpp=5.0 kV, at the frequency of 400 Hz, by changing the linear velocity of the intermediate transfer belt 50 from 282 mm/s to, down to 141 mm/s, i.e., a half value. As a result, an image having a good level with an acceptable image quality as a product of rank 4 is obtained. Thus, it is possible to change the number of period of the alternating electric field by controlling the rotational speed of the drive motor 76 using the toner deterioration determination means 120.

Next, it is confirmed that there is no problem on the image even if the number of the period of the alternating voltage in the secondary transfer nip N increases when the toner is not deteriorated.

First, while the transfer bias is set so that Voff=−1.0 kV, Vpp=5.0 kV, the frequency is 400 Hz, and the linear velocity is 282 mm/s, the solid images have been output continuously until the image with no white missing pattern is output. Then, while the transfer bias is set to Voff=−1.0 kV, Vpp=5.0 kV, the linear velocity at 282 mm/s, a transfer performance of the mixed image including, letters, lines, a picture, etc. is evaluated by changing the frequency by the increment of 200 Hz from 400 Hz to 2000 Hz.

As for the evaluation on transfer performance, the transfer image is evaluated using five steps evaluation with respect to the toner scattering and the image density at the recess portion. For the image density at the recess portion, the similar evaluation criteria described previously is used. As for the toner scattering, the rank 5 is given if the image is fine, the rank 4 is given if the clearness is slightly degraded, but acceptable as the product, the rank 3 is given if the clearness is degraded, compared to rank 4, but acceptable as the product, the rank 2 is given if the clearness is degraded further, compared to rank 3 and not acceptable as the product, and the rank 1 is given if the image is not clear to identify. Table 2 shows the evaluation results of transfer performance depending on the setting frequency.

TABLE 2

| | Frequency (Hz) | | | | | | | | |
|---|---|---|---|---|---|---|---|---|---|
| | 400 | 600 | 800 | 1000 | 1200 | 1400 | 1600 | 1800 | 2000 |
| Transfer performance in recess portion | 4 | 4 | 5 | 5 | 5 | 5 | 5 | 5 | 5 |
| toner scattering | 4 | 4 | 3 | 3 | 3 | 3 | 2 | 2 | 2 |

As shown in Table 2, it is found that there is no problem on transfer performance in the recess portions at any frequency, but the level of the toner scattering is degraded with the increase of the frequency. Further, a degradation of the toner scattering is observed similarly to the case in which the transfer frequency is increased when the linear velocity is set to 141 mm/s even at the frequency of 400 Hz. Furthermore, when the linear velocity is made slow to increase the number of periods of alternating voltage in the secondary transfer nip N, there is a problem that the productivity to form the image is decreased.

As described above, it is found that it is possible to prevent the toner transfer performance in the recess from declining even when the toner is deteriorated if the number of the period of the alternating voltage in the secondary transfer nip N is increased. However, it is also found that there are side effects, for example, toner scattering becomes worse when the toner is not deteriorated. The present inventors have investigated how to obtain a high transfer performance of the toner to the recessed portions with the deteriorated toner while reducing such side effects. As a result, the present inventors have devised a way to change the setting of the number of periods of alternating electric field in the secondary transfer nip N based on the determining criteria for the toner deterioration.

When the toner is determined to be deteriorated based on the criteria of the toner deterioration, the number of the period of the alternating voltage in the secondary transfer nip N is set to a setting value for the deteriorated toner, and when the toner is determined not to be deteriorated based on the criteria of the toner deterioration, the number of the period of the alternating voltage in the secondary transfer nip N is set to a setting value for the normal toner which is not deteriorated. Using this procedure, the number of periods of alternating voltage is increased only when it is determined that the toner is deteriorated, and it is set to the minimum required cycle when the toner is not deteriorated. Accordingly, it is possible to reduce the side effects such as worsening of the toner scattering.

Thus, in this embodiment, when the toner deterioration determination means 120 determines that the toner is deteriorated, the number of periods of the alternating electric field is set to a value larger than that when the toner deterioration determination means 120 determines that the toner is not the deteriorated. Further, the change of the number of the periods of the alternating electric field is performed by controlling the toner deterioration determination means 120 so that the frequency of the alternating field formed by the power supply 110 is changed.

As the determination method of the toner deterioration, there are a variety of methods, for example, checking the condition whether or not it satisfies the condition in which the toner is expected to be deteriorated, and using some toner deterioration detection unit installed in the image forming apparatus.

As the condition in which the toner is expected to be deteriorated, there are many cases, for example, a stressed condition in which the toner receives stress in the image forming apparatus for a long time without being consumed to form a toner image. More specifically, as shown in the example embodiment, there is a case in which the images occupied by an actual image area by less than a predetermined value are output continuously for a predetermined time, or more than a predetermined number.

However, in reality, there are a variety of print outputting situations, for example, the number of continuous image output is less than a predetermined number, but, low image area rate images are output several times continuously between the outputs of the image occupied by an actual image area with a high percentage. Thus, it is difficult to predict the toner deterioration.

Accordingly, it is more accurate to determine the toner deterioration based on the detection information of the toner degradation detection means 120 by providing it in the image forming apparatus. Various examples shown in the patent applications can be applied as the toner degradation detection means 120. Further, for example, in the following patent publications 1 through 5, the standard pattern image for the measurement is developed on the photoreceptor, and the transfer rate in the primary transfer process is measured by the various types of sensors, so that the toner deterioration is detected by the change in the transfer rate. Further, when the toner is deteriorated, the image density on the photoreceptor decreases due to the decrease of the developing performance of the toner. Therefore, the developing bias may be raised to ensure the image density. When the image density cannot be kept at a predetermined level by increasing the developing bias up to the upper limit of the developing bias, the deteriorated toner may be forced to be developed to output: (1) Patent Publication No. 2007-304316, (2) Patent Publication No. 2004-240369, (3) Patent Publication No. 06-003913, (4) Patent Publication No. 08-227201, and (5) Patent Publication No. 2006-251409. Therefore, in this embodiment, the method to determine whether or not the toner is deteriorated by the transfer rate at the primary transfer process is described.

Figure 5:
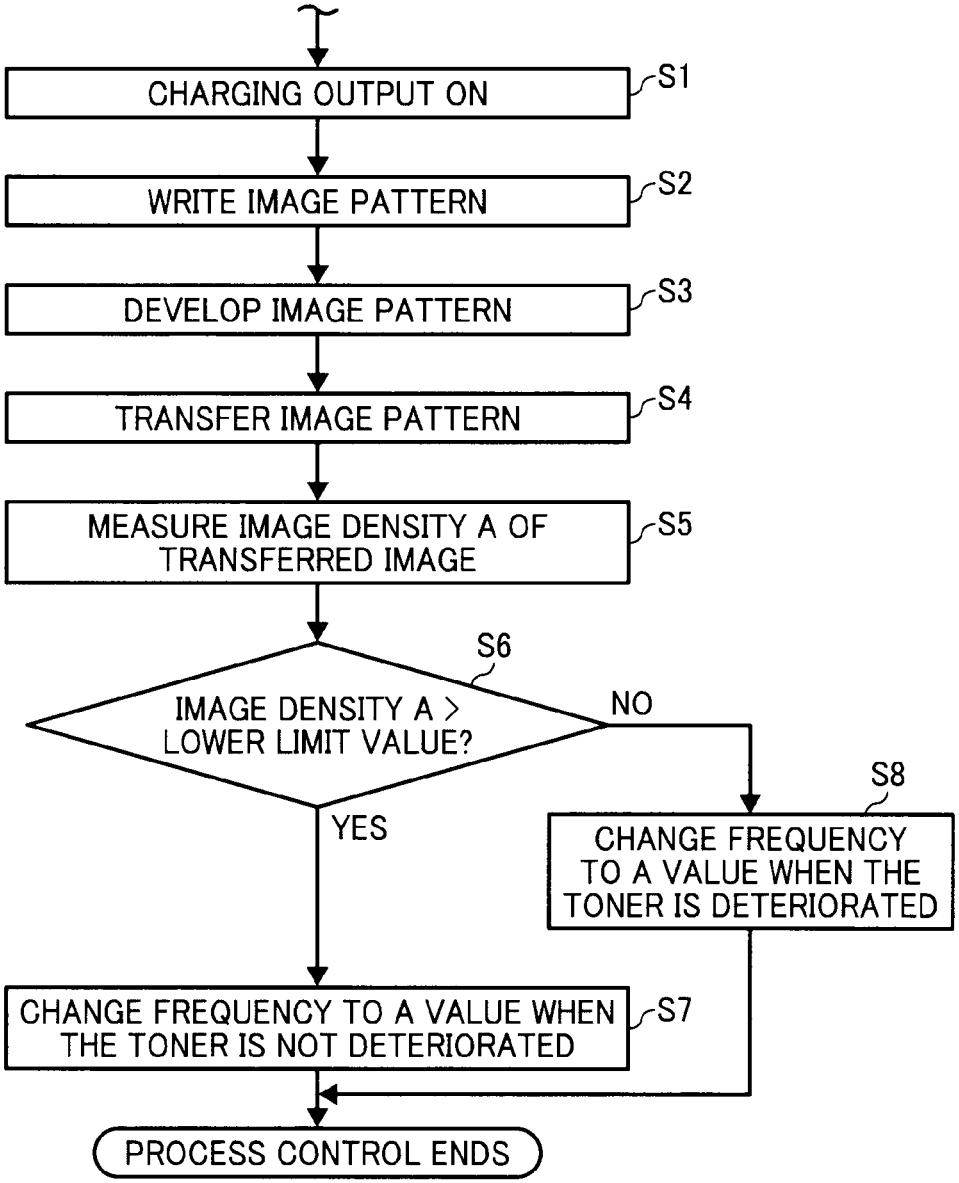
FIG. 5 is a flow chart showing an example of toner deterioration determination process performed by a toner status determination unit.

FIG. 5 shows a control flow chart in which the frequency of the AC voltage is changed after determining the toner deterioration from the transfer rate. This control is performed by the toner deterioration determination means 120.

In FIG. 5, in step S1, following the end of a known process control successively, the charging output is made on by controlling the power supplies of the charging devices 21, 22, 23 and 24. In step S2, the image pattern is written on each photoreceptor with the light amount corresponding to the image density set, and is developed in step S3.

The image pattern is transferred onto the intermediate transfer belt 50, in the step S4. The image density A of the transferred image is measured by the image density sensor 75, in step S5. In step S6, it is determined whether or not the image density is higher than the predetermined lower limit of the image density (threshold). When it satisfies the condition, it is determined that the transfer rate is not declined and the toner is not deteriorated, then, proceeds to step 7, and the frequency of the AC voltage is set to a setting value which is the setting value when the toner is not deteriorated. Then, this control ends. By contrast, when it does not satisfy the condition, it is determined that the transfer rate is declined and the toner is deteriorated, then, the process proceeds to step S8, and the frequency of the AC voltage is set to a predetermined value which is the setting value when the toner is deteriorated. Then, this control ends.

Figure 6:
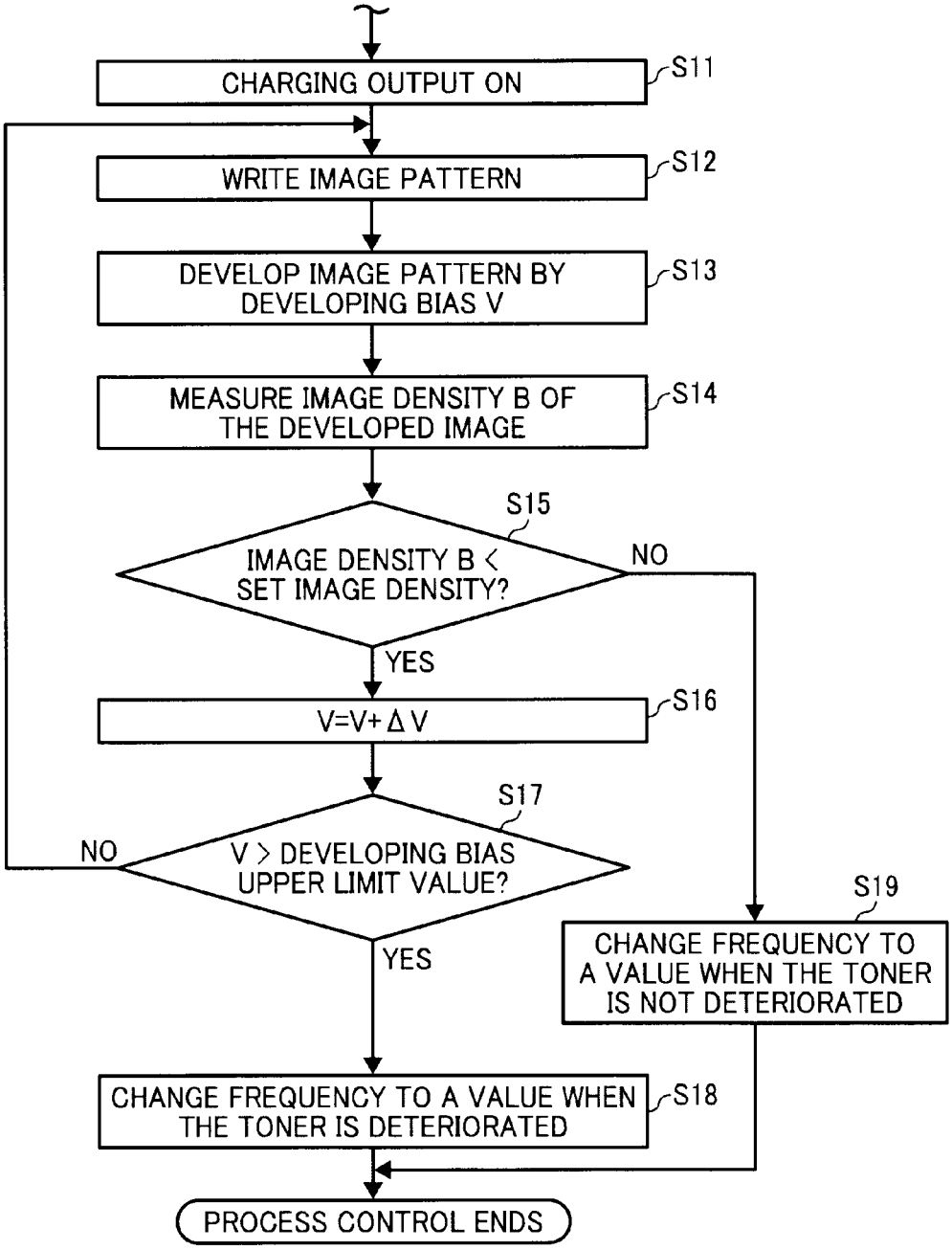
FIG. 6 is a flow chart showing another example of the toner deterioration determination process performed by a toner status determination unit.

Next, the case to determine the deterioration of the toner based on the image density on the photoreceptor is described. FIG. 6 shows the control flowchart in this case. This control is performed by the toner deterioration determination means 120.

In FIG. 6, in step S11, following the end of a known process control successively, the charging output is made on by controlling the power supplies of the charging devices 21, 22, 23 and 24. The image pattern is written on each photoreceptor with the light amount corresponding to the image density set in step S12, and is developed by the developing bias V in step S13. The image density B of the developed image is measured by the image density sensor 121, 122, 123 and 124, in step S14. In step S15, it is determined whether or not the image density B is lower than the predetermined image density (threshold), and when it does not satisfy the condition, it is determined that the toner is not deteriorated, then proceeds to step 19. In step 19, the frequency of the AC voltage is set to a setting value when the toner is not deteriorated, then the control ends. By contrast, when it satisfies the condition, it proceeds to step S16. In step S16, the developing bias V is increased by the bias increase value of $^{\Delta}$V. Then, in step S17, it is determined whether or not the developing bias V which is increased by this $^{\Delta}$V is larger than the voltage set as the upper limit value of the developing bias. When it does not satisfy the condition, the process returns to step 12, the image pattern is developed and the image density of the image pattern is measured again by the development and image density sensors 121, 122, 123 and 124. When it satisfies the condition, it is determined that the toner is deteriorated, and in step S18, the frequency of the AC voltage is set to a setting value when the toner is deteriorated. Then, the control ends.

In the control flow described above, the control process is performed following to the end of the known control successively, however, it may be performed at different timing from the existing process control, in consideration of the circumstances of the output condition.

The present inventors have conducted further investigation. The research results will be described.

Figure 7:
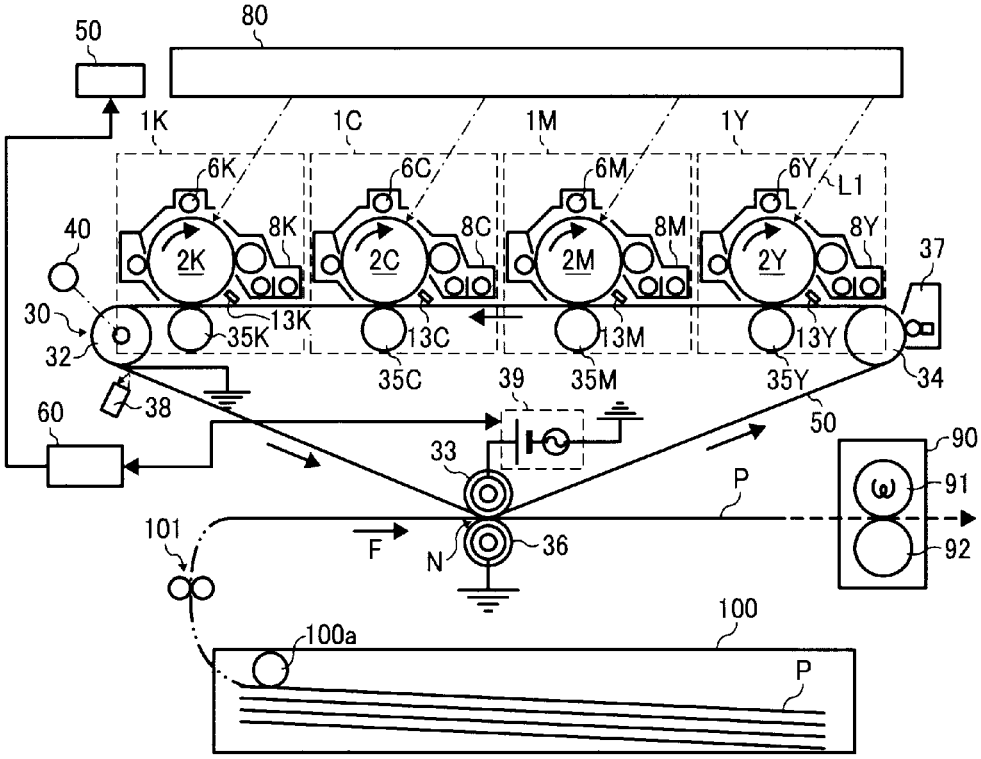
FIG. 7 is a schematic diagram of a printer as an image forming apparatus according to the present invention.

Referring to figures, the embodiment of a color printer using the electro photographic method (hereinafter, simply referred as "printer") is described below as an application example of image forming apparatus according to the present invention. FIG. 7 is a schematic diagram of an embodiment of a printer according to the present invention. In FIG. 7, the printer includes four image forming units, 1Y, 1M, 1C and 1K to form yellow (Y), magenta (M), cyan (C), black (K) toner images, respectively, a transfer unit 30 that works as a transfer device, a light writing unit 80, a fixing unit 90, a paper feed cassette 100, a registration roller pair 101, a controller 60 that is the control means, and a toner deterioration determination means 70 which determines the deterioration state of the toner.

Four image forming units, Unit 1Y, 1M, 1C and 1K, use different color toners of Y, M, C and K, as an image forming material, respectively, however, the other configurations are similar to each other and the image forming unit is provided to be able to replace when the life ends. Therefore, the image forming unit 1K for forming toner image K is described as the typical example. As shown in FIG. 8, this unit includes a photoreceptor 2K having a drum shape, a drum cleaning device 3K, an electricity removal unit (not shown), a charging unit 6K, a developing unit 8K, etc.

In the image forming unit 1K, those components are held by a common casing and configured to be detachable integrally to the printer body so that it is possible to exchange those components simultaneously.

The photoreceptor 2K is formed of an organic photosensitive layer on the surface of the drum shaped base and is driven to rotate in a clockwise direction by a drive unit, not shown. The charging unit 6K charges a surface of the photoreceptor 2K uniformly by causing a discharge between the photoreceptor roller 7K and the photoreceptor 2K, while the photoreceptor roller 7K to which the charging bias is applied is contacted with, or close to the photoreceptor 2K. In this printer, the surface of the photoreceptor 2K is uniformly charged at a negative polarity same as the normal charging polarity of the toner. More specifically, it is charged to −650 [v] uniformly.

In this embodiment, the charging bias is a voltage formed by superimposing an AC voltage on a DC voltage. The charging roller 7K is formed by coating a conductive elastic layer made of elastic conductive material on a surface of the metal core.

Replacing the system in which charging member such as the charging roller, etc., is made close to or in contact with the photoreceptor 2K, a charging system using the charger may be employed.

On the surface of the photoreceptor 2K charged uniformly by the charging device 6K, an electrostatic latent image of K formed by being scanned by the laser light emitted from the optical writing unit 80 is carried. The potential of the electrostatic latent image for K is about −100 [V]. The electrostatic latent image for K becomes a K toner image by being developed by a developing device 8K using the K toner (not shown). Then, the K toner image is transferred primarily onto the intermediate transfer belt 31 which is an intermediate transfer body and is an image carrier having a belt shape described later.

Above the image forming units 1Y, 1M, 1C and 1K, the optical writing unit 80 to write the latent image is disposed. The optical writing unit 80 scans the laser light emitted from a light source such as the laser diode on the photoreceptors, 2Y, 2M, 2C and 2K, based on the image information sent from an external device such as a personal computer. By this optical scanning, the electrostatic latent images for Y, M, C and K are formed on the photoreceptors, 2Y, 2M, 2C and 2K, respectively. More specifically, in the uniformly charged surface of the photoreceptor 2Y, the potential at the portions irradiated with the laser light is attenuated. Then, the potential of the electrostatic latent image at the portions irradiated by the laser becomes the electrostatic latent image having a potential lower than that at the other spot (background portion). Further, the optical writing unit 80 irradiates the laser beam L emitted from the light source to each photoreceptor through a plurality of optical lenses and mirrors by polarizing in the main scanning direction by a polygon mirror driven to rotate by a polygon motor, not shown. As the optical writing unit 80, a unit which writes the image on the photoreceptors 2Y, 2M, 2C and 2K by LED lights emitted from the LED array formed of multiple LEDs may be used.

The drum cleaning device 3K removes the transfer residual toner adhered on the surface of the photoreceptor 2K, after the primary transfer process (at the primary transfer nip described later). The drum cleaning device 3K includes a cleaning brush roller 4K driven to rotate, and a cleaning blade 5K to be in contact with the photoreceptor 2K with the free end thereof and being cantilevered. The drum cleaning device 3K scraps the transfer residual toner off from the surface of the photoreceptor 2K by the rotating cleaning brush roller 4K, and the transfer residual toner is dropped off from the surface of the photoreceptor 2K by the cleaning blade. The cleaning blade is brought into contact with the photoreceptor 2K putting the cantilevered support end thereof at a position of the downstream side in a counter direction of the drum rotation from the free end side thereof.

The neutralization unit described above neutralizes the residual charge of the photoreceptor 2K after the cleaning process by the drum cleaning device 3K. By this neutralization, the surface of the photoreceptor 2K is initialized for the following image forming.

The developing unit 8K includes a developing unit 12K that includes a developing roller 9K and a developer conveying unit 13K to convey and stir the K developing agent, (not shown). The developing agent transport unit 13K includes a first transfer chamber having a first screw member 10K and a second transfer chamber having a second screw member 11K. These screw members include a rotary shaft member supported rotatably by bearings at the both ends thereof in each axis direction, and projecting spiral vanes provided on the peripheral surface of the rotary shaft member.

The first transfer chamber that includes the first screw member 10K and the second transfer chamber that includes the second screw member 11K are separated by a partition wall, however, communicating ports are formed at the both ends of the partition wall in the screw axis direction to communicate between both the transfer chambers. The first screw member 10K conveys the developing agent K (not shown) held in the spiral blades toward the front side from the back side in a direction orthogonal to the plane of the figure, while stirring the developer in the rotary drive rotating direction in accordance with the drive rotation. Since the first screw member 10K and the developing roller 9K described later are arranged in parallel to face each other, the conveyance direction of the developer K in this case is also along the direction of the rotation axis of the developing roller 9K. And, the first screw member 10K supplies the K developer along the axial direction to the surface of the developing roller 9K.

The K developer conveyed to near the end of the front side of the first screw member 10K in the figure enters in the second transfer chamber through the communication opening formed near the edge of the front side of the partition wall in the figure. After the K developer enters into the second transfer chamber, the K developer is held in a spiral wing of the second screw member 11K, and is conveyed toward the back side from the front side in the figure, while being stirred in the direction of rotation in accordance with the drive rotation of the second screw member 11K.

In the second transfer chamber, a toner density sensor (not shown) is provided at the lower wall of the casing to detect the toner density of the K developer in the second transfer chamber. As the K toner density sensor, a permeability sensor may be used. Since there is a correlation between the K toner density and the permeability of the K developer which includes the K toner and magnetic carrier and is so-called two-component developer, the magnetic permeability sensor can detect the K toner density.

This printer includes each color toner supply means for Y, M, C and K, (not shown) in the second chamber of the developing device for Y, M, C and K to replenish the respective toner. Further, the printer control unit 60 stores Vtref values for K, M, C and K in the RAM, which are the target values for the output voltage from the toner density sensor for K, M, C and K, respectively. When the difference between each output voltage from the toner density sensor for Y, M, C and K and the Vtref value for Y, M, C and K exceeds a predetermined value, the toner supply means for Y, M, C and K is driven for a time corresponding to the difference. Thus, the Y, M, C and K toners are replenished in the second transfer chamber of the developing units Y, M, C and K, respectively.

The developing roller 9K included in the developing unit 12K faces the first screw member 10K, and faces the photoreceptor 2K through the opening formed in the casing. Further, the developing roller 9K includes a developing sleeve formed of a cylindrical non-magnetic pipe and a fixed magnet roller which does not rotate together with the sleeve inside the sleeve. The developing roller 9K conveys the K developing agent supplied from the first screw member 10K to a developing area facing the photoconductor 2K by carrying the toner on a surface of the sleeve by the magnetic force emitted from the magnet roller in accordance with the rotation of the sleeve.

To the developing sleeve, a developing bias voltage which has a polarity same as the toner, is higher than the potential of the electrostatic latent image, and is smaller than the potential of the uniformly charged photoreceptor 2K is applied. Accordingly, there is a developing potential difference between the developing sleeve and the electrostatic latent image on the photoreceptor 2K which is acting to move the K toner on the developing sleeve to the latent image electrostatically. In addition, there is a non-developing potential difference between the developing sleeve and the bare area of the photoreceptor 2K which is acting to move the K toner towards the surface of the developing sleeve electrostatically. By the developing potential difference and the non-developing potential difference, the K toner on the developing sleeve is transferred selectively so that the electrostatic latent image is developed to form the K toner image.

An image density sensor 113K is disposed at a downstream from the developing unit 8K in the direction of rotation of the photoreceptor 2K to measure the image density of the developed toner image on the photoreceptor 2K. The image forming units 1Y, 1M and 1C also include image density sensors 113Y, 113M and 113C to measure the image density of the developed toner image formed on the photoreceptors 2Y, 2M and 2C, similarly.

In the image forming units 1Y, 1M and 1C, shown in FIG. 7 described earlier, the toner images of Y, M and C are formed on the photoreceptor, 2Y, 2M and 2C, respectively, similarly to the image formation unit 1K for K.

Underneath of the image forming units, 1Y, 1M, 1C and 1K, a transfer unit 30 is disposed to move an endless intermediate transfer belt 31 which is extended among the rollers in a counterclockwise direction in FIG. 7. The transfer unit 30 includes a drive roller 32, a secondary intermediate transfer back roller 33, a cleaning backup roller 34, four primary transfer rollers, 35Y, 35M, 35C and 35K, which are the primary transfer members, a nip roller 36, a belt cleaning device 37 and the like in addition to the intermediate transfer belt 31 that is an image carrier.

An endless intermediate transfer belt 31 is extending among a drive roller 32 disposed inside the loop of the belt, a secondary transfer back roller 33, a cleaning back up roller 34 and four primary transfer rollers, 35Y, 35M, 35C and 35K. And, in this embodiment, the endless intermediate transfer belt 31 is moved endlessly in the counterclockwise direction in the figure by a rotational force of the drive roller 32 driven to rotate in the counterclockwise direction by the drive motor 40 that is the drive means.

Further, the intermediate transfer belt 31 is formed of endless carbon dispersion polyimide resin, having a thickness of 40 μm to 200 μm, preferably about 60 μm, and the volume resistivity of 1 E6 Ωcm to 1 E12 Ωcm, preferably about 1 E9 Ωcm (measured under an applied voltage of 100V using Hiresta UP MCP HT450 manufactured by Mitsubishi Chemical).

The intermediate transfer belt 31 which moves endlessly is tucked between the primary transfer rollers, 35Y, 35M, 35C and 35K and the photoreceptors, 2Y, 2M, 2C and 2K. Accordingly, the primary transfer nip for Y, M, C and K is formed between the front surface of the intermediate transfer belt 31 and the photoreceptors, 2Y, 2M, 2C and 2K, respectively. To the primary transfer rollers 35Y, 35M, 35C and 35K, a primary transfer bias is applied by the primary transfer bias power source (not shown). Thus, the transfer electric field is formed between each toner image Y, M, C and K, on the photoreceptors, 2Y, 2M, 2C and 2K and the primary transfer rollers, 35Y, 35M, 35C and 35K. The Y toner formed on the surface of the photoreceptor 2Y for Y enters in the primary transfer nip for Y in accordance with the rotation of the photoreceptor 2Y, and, is transferred primarily by the action of the transfer electric field and the nip pressure so that the Y toner moves from the photoreceptor 2Y onto the intermediate transfer belt 31. The intermediate transfer belt 31 that holds the toner image Y transferred primarily, then, passes through the primary transfer nip for M, C and K, sequentially. Then, the toner images of M, C and K on the photoreceptor, 2M, 2C and 2K are transferred sequentially and are superimposed on the Y toner image. By the primary transfer of this superimposition, a four-color superimposed toner image is formed on the intermediate transfer belt 31.

The primary transfer roller 35Y, 35M, 35C and 35K includes a metal core made of metal and an elastic roller having a conductive sponge layer fixed on the surface of the metal core. The primary transfer rollers 35Y, 35M, 35C and 35K are arranged so that the axis of each shaft center occupies the position shifted by about 2.5[mm] to the downstream side in the direction of movement of the belt from the shaft center of the photoreceptor, 2Y, 2M, 2C and 2K, respectively.

The outer dimension of the primary transfer rollers 35Y, 35M, 35C and 35K is 16 mm, and the diameter of the metal core is 10 mm. The resistance R of the sponge layer is about 3 to $10\times10^7\Omega$ as a value when it is calculated using Ohm's law (R=V/I) from the current I which flows when a voltage V of 1000V is applied to the metal core of the primary transfer roller while being pushed by the metal roller which has the outer diameter of 30 mm and is grounded. For such primary transfer rollers 35Y, 35M, 35C, and 35K, the primary transfer bias is applied under a constant current control. Further, a transfer charger, a transfer brush and the like may be employed replacing the primary transfer rollers 35Y, 35M, 35C and 35K.

A nip roller 36 in the transfer unit 30 is disposed outside the loop of the intermediate transfer belt 31, and tucks the intermediate transfer belt 31 with the secondary transfer back roller 33 disposed inside the loop of the intermediate transfer belt 31. Accordingly, the secondary transfer nip N is formed between the front surface of the intermediate transfer belt 31 and the nip roller 36. In the example shown in FIGS. 7 and 8, the nip roller 36 is grounded, on the other hand, the secondary transfer bias is applied to the secondary transfer back rollers 33 by the secondary transfer bias power supply 39 with a voltage. Thus, the secondary transfer electric field is formed to move the toner of negative polarity electrostatically from the side of the secondary transfer back roller 33 to the side of the nip roller 36.

Underneath the secondary transfer back roller 33, a paper feed cassette 100 is provided in a state in which multiple recording papers P are stacked. The Paper feed cassette 100 includes a feeding roller 100*a* which abuts the top recording paper P on top of the stacked paper. Then, the feeding roller 100*a* is driven to rotate at a predetermined timing to feed the recording paper P toward the paper feeding path. At near the end of the paper feeding path, a registration roller pair 101 is disposed. The registration roller pair 101 stops to rotate immediately when the rollers catch the recording paper P fed from paper feed cassette 100 therebetween. And the registration roller pair 101 starts to rotate again at a timing so as to synchronize to form a four-color toner image by superimposing four color toner images on the intermediate transfer belt 31, and sends the recording paper P towards the secondary transfer nip. The four-color toner image superimposed on the intermediate transfer belt 31 contacted to the recording paper P at the secondary transfer nip N is transferred secondarily onto the recording paper P by the action of the secondary transfer electric field and the pressure of the nip so as to form a full color toner image by combining with the white color of the recording paper P. Thus, after the recording paper P having the full color toner image formed on the surface thereof passes through the secondary transfer nip N, the recording paper P separates from the curvature of the nip roller 36 and the intermediate transfer belt 31.

The secondary transfer back roller 33 includes a metal core and a rubber layer coated by a conductive NBR rubber on the surface thereof. Further, the nip roller 36 also includes a metal core and a rubber layer coated by a conductive NBR rubber on the surface thereof.

The outer diameter of the secondary transfer back roller 33 is 24 mm approximately, and the diameter of the metal core is 16 mm and is formed of NBR rubber conductive layer (about from $1\times10^6$ to $2\times10^7\Omega$ measured by the same measurement method as that for the primary transfer roller). Further, facing the drive roller 32, an image density sensor 38 is disposed to detect the density of the toner image on the intermediate transfer belt 31. When the toner image transferred onto the intermediate transfer belt 31 passes over the drive roller 32, the image density is measured by the image density sensor 38.

The power supply 39 is configured to output a voltage to transfer the toner image on the intermediate transfer belt 31 to the recording material P captured in the secondary transfer nip N (hereinafter, referred to "secondary transfer bias"), and includes a DC power supply and an AC power supply, and outputs a superimposed bias voltage formed by superimposing an AC voltage on a DC voltage as the secondary transfer bias. In this embodiment, as shown in FIG. 7, the secondary transfer bias is applied to the secondary transfer back roller 33, while the nip roller 36 is grounded.

Figure 9:
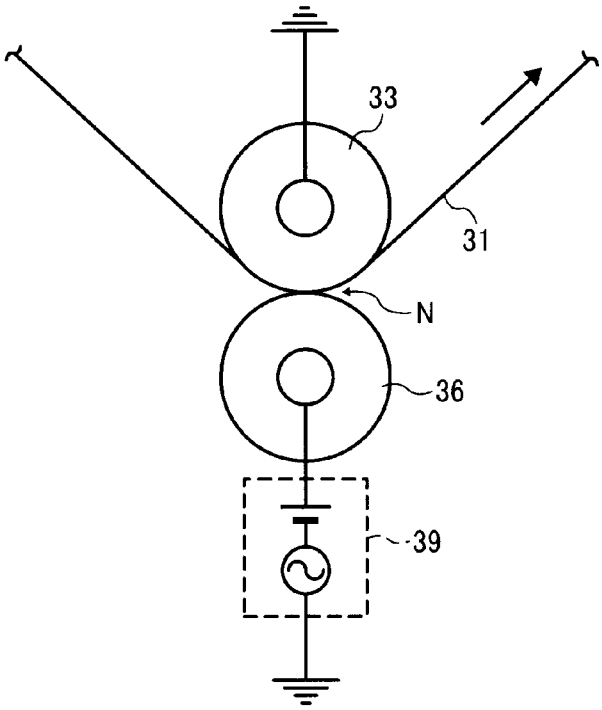
FIG. 9 is an enlarged view showing an embodiment of a secondary transfer power supply and voltage supply used in the image forming apparatus shown in FIG. 7.

A form of the secondary transfer bias supply is not limited to the embodiment of FIG. 7. However, as shown in FIG. 9, the superimposed bias from the power supply 39 may be applied to the nip roller 36 while the secondary transfer back roller 33 is grounded. In this case, the different polarity is used for the DC voltage. More specifically, as shown in FIG. 7, using the toner having a negative polarity while the nip forming roller 36 is grounded, when superimposed bias is applied to the secondary transfer back roller 33, as the DC voltage, the voltage of negative polarity same as that for the toner is used and the time average potential is set to a voltage equal to that of the toner, which is negative.

By contrast, in the embodiment as shown in FIG. 9, when the secondary transfer back roller 33 is grounded and the superimposed bias is applied to the nip roller 36, a DC voltage having a polarity opposite to that of the toner is used, more specifically, the potential of the time-averaged potential of the superimposed bias is set to a positive polarity opposite to that of the toner.

Figure 10:
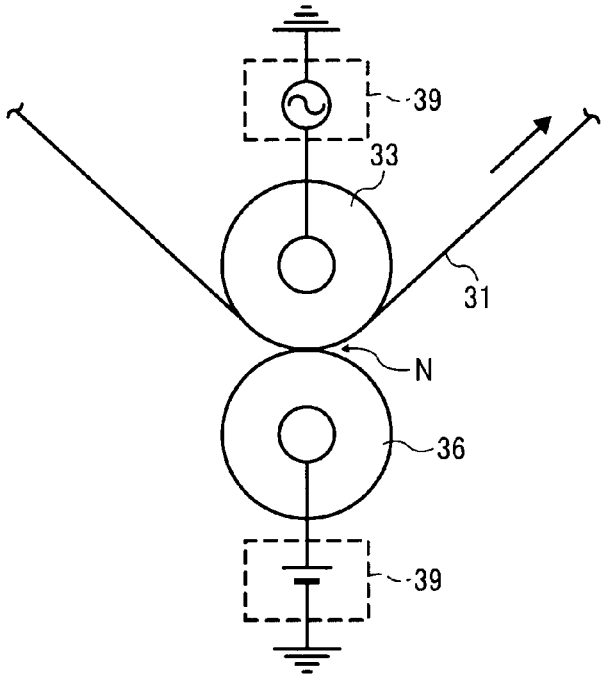
FIG. 10 is an enlarged view showing another embodiment of the secondary transfer power supply and voltage supply used in the image forming apparatus.
Figure 11:
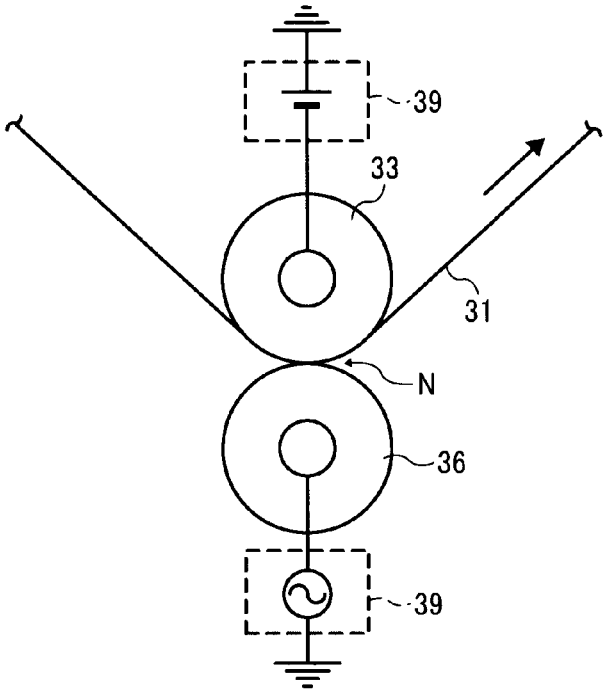
FIG. 11 is an enlarged view showing another embodiment of the secondary transfer power supply and voltage supply used in the image forming apparatus.

As the form of the superimposed bias which becomes the secondary transfer bias, a superimposed bias is not applied to either one of the secondary transfer back roller 33 or the nip roller 36, but, as shown in FIGS. 10 and 11, a DC voltage from the power supply 39 may be applied to the one of the rollers, and an AC voltage from the power supply 39 may be applied to the other one of the rollers.

Figure 12:
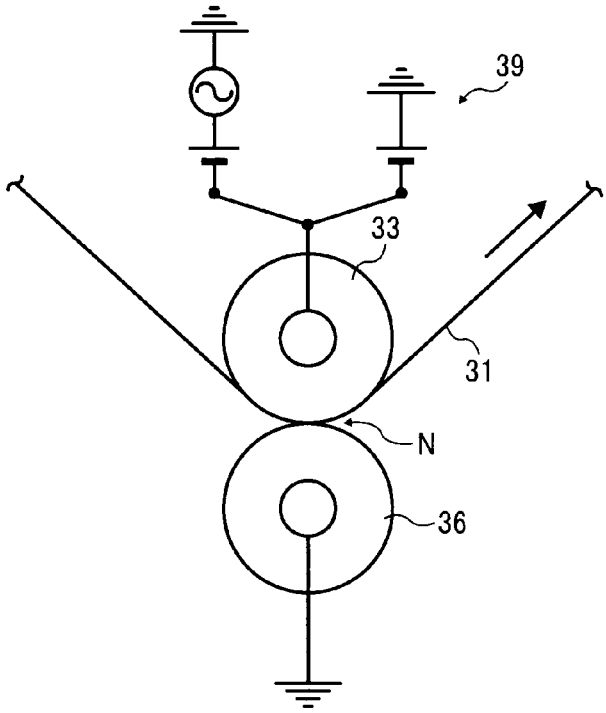
FIG. 12 is an enlarged view showing another embodiment of the secondary transfer power supply and voltage supply used in the image forming apparatus.
Figure 13:
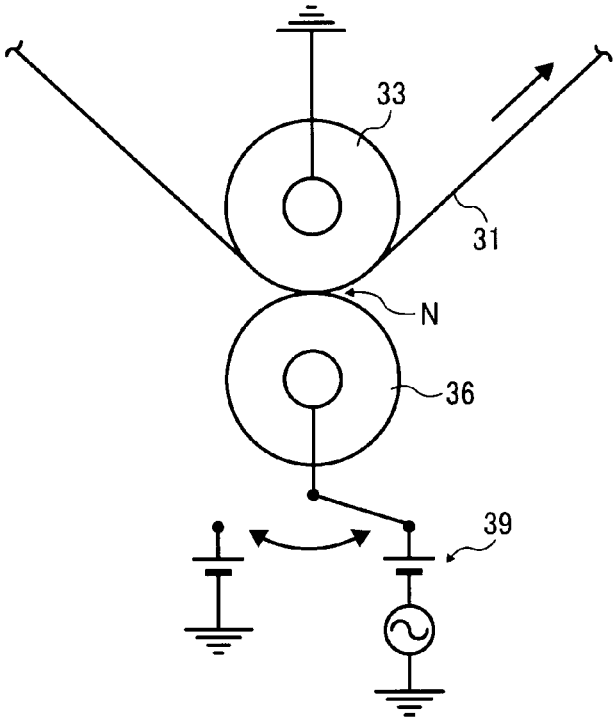
FIG. 13 is an enlarged view showing another embodiment of the secondary transfer power supply and voltage supply used in the image forming apparatus.

Further, as the form of the superimposed bias is not limited to the form described above. As shown in FIGS. 12 and 13, either a DC voltage or a sum of a DC voltage and an AC voltage may be applied to the one of the rollers by switching them. In the form of FIG. 12, either a DC voltage or a sum of a DC voltage and an AC voltage can be applied to the secondary transfer back roller 33 from the power supply 39 by switching them. In the form of FIG. 13, either a DC voltage or a sum of a DC voltage and an AC voltage can be applied to the nip roller 36 from the power supply 39 by switching them.

Figure 14:
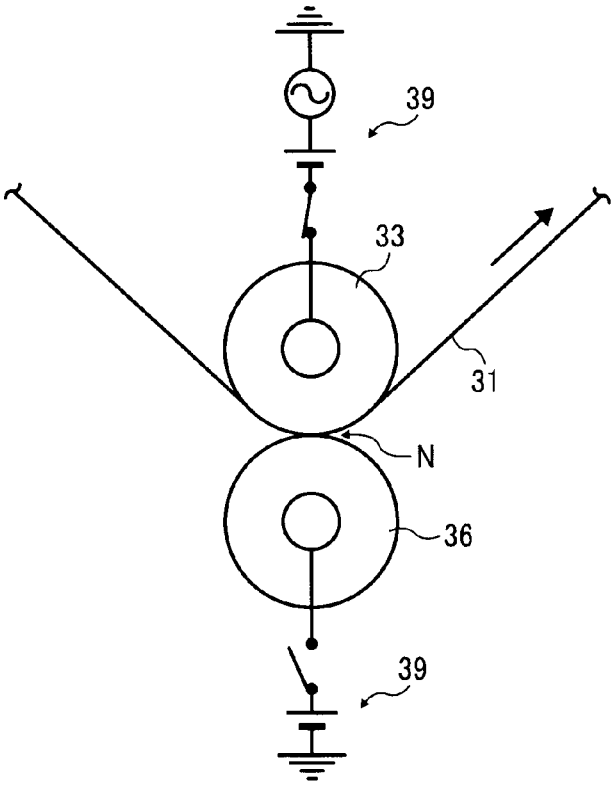
FIG. 14 is an enlarged view showing another embodiment of the secondary transfer power supply and voltage supply used in the image forming apparatus.
Figure 15:
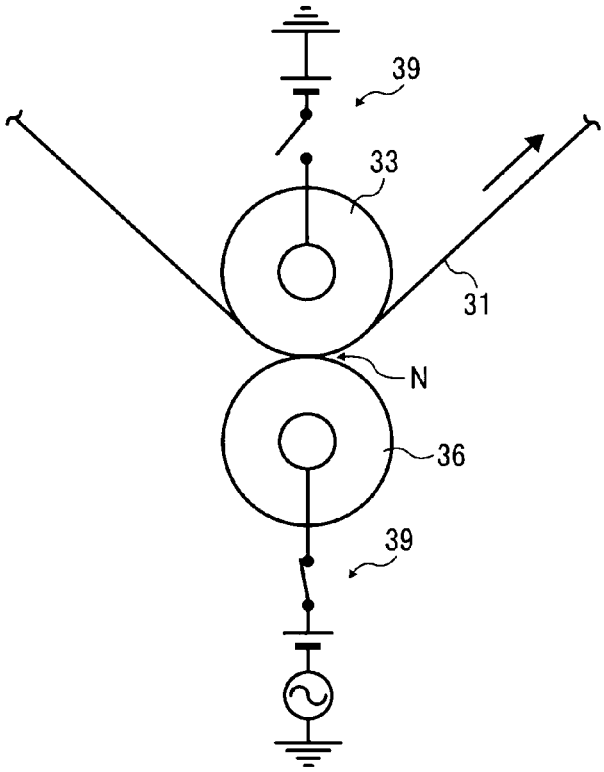
FIG. 15 is an enlarged view showing another embodiment of the secondary transfer power supply and voltage supply used in the image forming apparatus.

Further, as the form to supply the secondary transfer bias, there are other ways. When it is switched between a sum of a DC voltage and an AC voltage and a DC voltage, as shown in FIGS. 14 and 15, it can be configured to supply a sum of a DC voltage and an AC voltage to the one of rollers, and a DC voltage may be supplied to the other one of the rollers, and the supply voltage may be switched appropriately. More specifically, in the form of FIG. 14, it is configured to supply a sum of a DC voltage and an AC voltage to the secondary transfer back roller 33, and a DC voltage may be supplied to the nip roller 36. In the form of FIG. 15, it is configured to supply a DC voltage to the secondary transfer back roller 33, and a sum of a DC voltage and an AC voltage may be supplied to the nip roller 36.

Thus, as the form to supply the secondary transfer bias for the secondary transfer nip N, there are a variety of different forms as the power source, for example, a power source which can supply a sum of the DC voltage and the AC voltage like the power source 39, a power source which can supply a DC voltage and an AC voltage separately, and a single power source which can supply both the sum of the DC voltage and the AC voltage or the DC voltage by switching them. In those cases, the configuration of the form may be selected appropriately depending on the supply form. The secondary transfer bias power source 39 is configured to switch two modes between the first mode in which a DC voltage is only output and the second mode in which a voltage by superimposing an AC voltage on the DC voltage (superimposed voltage) is output. Further, in the forms shown in FIG. 7 and FIGS. 9 through 11, it becomes possible to switch the modes by turning on/off the output of the AC voltage. In the forms shown in FIGS. 12 through 15, it is configured to have two power sources so that it becomes possible to switch two modes by switching the power supplies selectively with switching means formed of, for example, the relay.

For example, when a paper having small surface irregularities such as plain paper is used as the recording paper P without using the paper having big surface irregularities like the rough paper, uneven shading pattern which follows the irregularities of the paper does not appear. Accordingly, the first mode is set in this case, and a voltage which consists of only a DC voltage is applied as the secondary transfer bias. Further, when the paper having large surface irregularities like the rough paper is used, the second mode is set, and a voltage formed by superimposing an AC voltage on a DC voltage is output as the secondary transfer bias. Thus, depending on the type of recording paper P to be used (the size of surface irregularities of the recording paper P), the type of the second secondary transfer bias may be selected by switching the modes between the first mode and the second mode.

The transfer residual toner which is not transferred onto the recording paper P is adhered on the intermediate transfer belt 31 after the intermediate transfer belt 31 passes through the secondary transfer nip N. The transfer residual toner is cleaned from the surface of the belt by the belt cleaning device 37 which abuts the front surface of the intermediate transfer belt 31. The cleaning backup roller 34 disposed inside the loop of the intermediate transfer belt 31 is to back up the cleaning operation of the belt performed by the belt cleaning device 37 from the inside of the loop.

At the center right in FIG. 7 which is the downstream side of the recording paper conveyance direction from the secondary transfer nip N, a fixing device 90 is disposed. The fixing device 90 includes the fixing roller 91 including the heat source such as a halogen lamp and the pressure roller 92 which rotates by contacting the fixing roller 91 at a predetermined pressure to form a fixing nip. The recording paper P fed into the fixing device 90 is captured by the fixing nip in a form so that the recording paper P bearing the unfixed toner image is contacting closely with the surface of the fixing roller 91. Then, the toner in the toner image is softened by the influence of heat and pressure so as to fix a full color image. The recording paper P output from the fixing device 90 passes through the conveyance path and is output to the outside the apparatus.

In this printer, mode information is stored in the control unit 60 so that it is possible to set a standard mode, a high quality image mode, and a high speed mode. A process linear velocity in the standard mode (linear velocity of the photoreceptor and the intermediate transfer belt) is set to approximately 352[mm/s]. However, in the high quality image mode in which the image quality is the higher priority than the printing speed, the process linear velocity is set to a value slower than the standard mode. Further, in the high speed mode in which the printing speed is the higher priority than the image quality, the process linear velocity is set to a value faster than that in the standard mode. The switching among the standard mode, the high quality image mode, and the high speed mode is performed by a user's key operation at the operation panel 50 provided on the printer (refer to FIG. 22), or at the printer properties menu of the personal computer connected to the printer.

In this printer, when a monochrome image is formed, primary transfer rollers 35Y, 35M and 35C are moved to positions away from the photoreceptors 2Y, 2M and 2C, by shifting the pivotable support plate (not shown) which supports the primary transfer roller 35Y, 35M and 35C for Y, M and C in the transfer unit 30, respectively. Thus, the front surface of the intermediate transfer belt 31 is separated from the photoreceptor 2Y, 2M and 2C, and the intermediate transfer belt 31 is only made to contact with the photoreceptor 2K for K. In this condition, only the image forming unit 1K for K among the four image forming units 1Y, 1M, 1C and 1K is driven to form a K toner image on the photoreceptor 2K.

In this printer, a DC component of the secondary transfer bias has the same value as the time averaged value of the voltage (Vave), i.e., the time average voltage value (time average value) Vave of the voltage, which is the voltage of the DC component. The time average value of the voltage Vave is a value of the integral of the voltage waveform over one period divided by the length of the period.

In the printer in which a secondary transfer bias is applied to the secondary transfer back roller 33 while the nip roller 36 is grounded, when the polarity of the secondary transfer bias is the negative polarity same as that of the toner, in the secondary transfer nip N, the toner of negative polarity is pushed electrostatically away from the secondary transfer back roller 33 to the nip roller 36. Thereby, the toner on the intermediate transfer belt 31 is transferred onto the recording paper P. By contrast, when the polarity of the superimposed bias is the positive polarity opposite to that of the toner, in the secondary transfer nip N, the toner of the negative polarity is attracted electrostatically from the nip roller 36 to the secondary transfer back roller 33. With this process, the toner transferred to the recording paper P is pulled back to the intermediate transfer belt 31 again.

Meanwhile, when a paper having large surface irregularities such as Japanese paper is used as the recording paper P, it tends to generate the shading pattern that follows the surface irregularities. In the image forming apparatus disclosed in Japanese Patent Publication No. 2004-258397A, a DC voltage is not only applied as a secondary transfer bias, but also a superimposed bias formed by superimposing a DC voltage to an AC voltage is applied.

Figure 16:
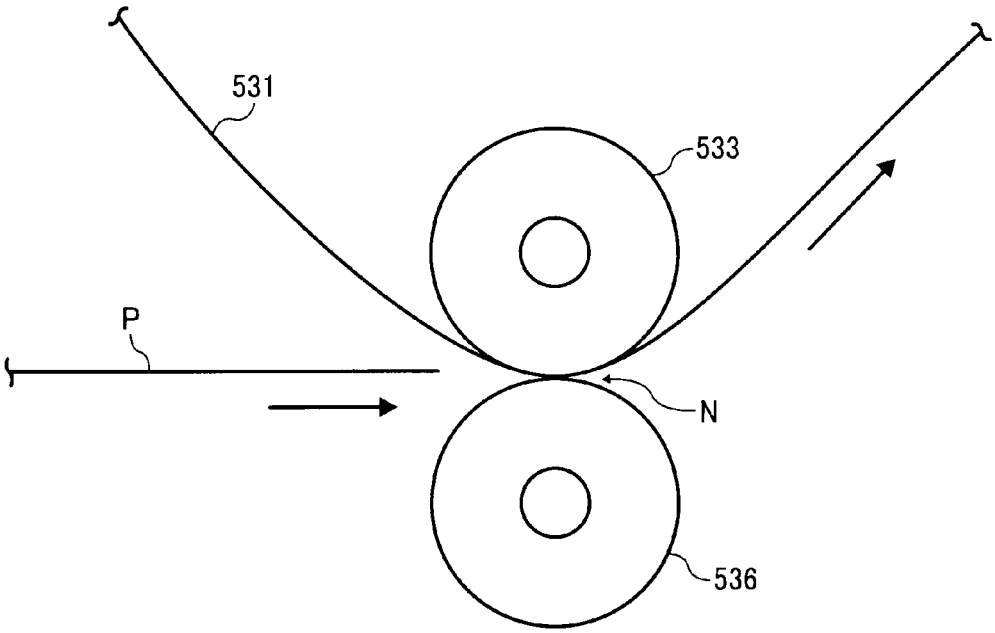
FIG. 16 is an enlarged view showing one example of the secondary transfer nip.

However, the present inventors have found from the experiments that in such a configuration, it tends to generate multiple white spots in the image formed at the recess portions of the paper surface. Therefore, the present inventors have been carrying out the research extensively on the possible causes of the white spots and have found the following facts. FIG. 16 is a conceptual diagram schematically showing an example of the secondary transfer nip N. In FIG. 16, the intermediate transfer belt 531 is pressed against the nip forming rollers 536 by the secondary transfer back roller 533 which abuts the rear surface of the intermediate transfer belt 531. Accordingly, the secondary transfer nip N is formed at portions where the secondary transfer nip forming roller 536 abuts the front surface of the intermediate transfer belt 531. The toner image on intermediate transfer belt 531 is transferred secondarily onto the recording paper P fed to the secondary transfer nip N. The secondary transfer bias to transfer the toner image secondarily is applied to either one of the two rollers shown in FIG. 16, while the other roller is grounded. It is possible to transfer the toner image onto the recording paper P when the transfer bias is applied to any one of the rollers. A case in which a secondary transfer bias is applied to the secondary transfer back roller 533 and a toner of negative polarity is used will be described as an example. In this case, in order to move the toner in the secondary transfer nip N from the secondary transfer back roller 533 to the nip roller 536, a potential whose time average value has the negative polarity same as the polarity of the toner is applied as the secondary transfer bias consisting of the superimposed bias.

Figure 17:
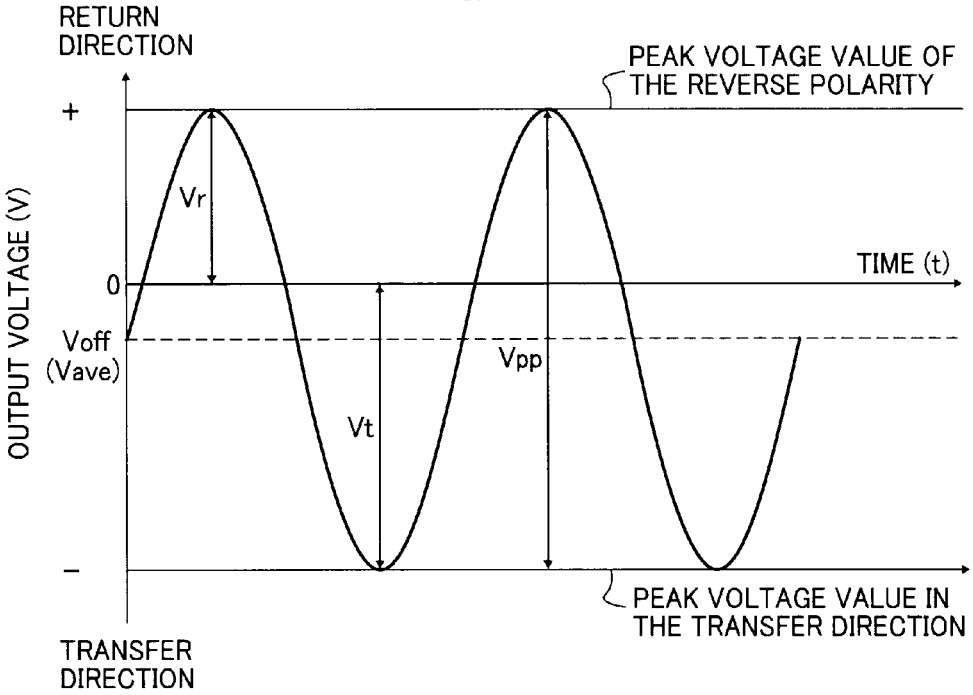
FIG. 17 is a graph illustrating a waveform of a voltage consisting of a superimposed bias.

FIG. 17 is a waveform showing an example of a secondary transfer bias which is formed of the superimposed bias to apply to the secondary transfer back roller 533. In FIG. 17, the average voltage with time (hereinafter, it is referred to "a time average value") Vave [V] represents the average value of secondary transfer bias with time. As shown in FIG. 17, the secondary transfer bias formed of the superimposed bias has a sinusoidal shape and a peak value in the return direction, and a peak value in the transfer direction. The reference numeral Vt denotes a peak value to move the toner from the belt to the nip roller 536 in the secondary transfer nip N (the transfer direction) among those two peak values, (hereinafter, "transfer direction peak value Vt") The reference numeral Vr denotes a peak value to move the toner from the nip roller 536 to the belt (the return direction) (hereinafter, "return peak value Vr"). Further, it is possible to use an alternating bias consisted only of an AC component to move the toner back and forth between the belt and the recording paper in the secondary transfer nip N, replacing the superimposed bias as shown in FIG. 17. However, the alternating bias can merely move the toner back and forth, and the toner cannot be transferred onto the recording paper P. By applying a superimposed bias containing a DC component and making the time average voltage Vave [V] to be a voltage having a negative polarity same as that of the toner, the toner is moved relatively to the recording paper while the toner is moving back and forth. Consequently, it is possible to transfer the toner from the belt side to the recording paper side.

The present inventors have investigated the back and forth movement of the toner and found following facts. That is, when it is started to apply the secondary transfer bias, only a small amount of the toner particles presenting on the surface of the toner layer on the intermediate transfer belt 531 leave the toner layer at the beginning, and move toward the recessed portions on the surface of the recording paper. However, most of the toner particles in the toner layer still stay in the toner layer. After the very small amount of the toner particles left from the toner layer and have entered into the recessed portions of the surface of the recording paper, the toner particles moves back to the toner layer from the recessed portions when the electric field is changed to have the reverse direction. At this time, the toner particles moving back collide against the toner particles stayed in the toner layer so as to make the adhesion strength of toner particles for the toner layer (or paper) weak. Then, when the electric field direction is turned reversely toward the recording paper P again, more toner particles than that at the beginning leave from the toner layer and move toward the recess portions of the surface of the recording paper. It is found that the number of toner particles is increased gradually so that a lot of toner particles are leaving from the toner layer and entering in the recess portions on the surface of the recording paper. Accordingly, a sufficient amount of toner particles is transferred in the recess portions by repeating a series of such processes.

Thus, in the configuration in which toner particles are moved back and forth, if the peak Vr shown in FIG. 17 is not set to a large value, it is not possible to bring the toner particles that enter in the recessed portions on the surface of the recording paper back to the toner layer on the belt sufficiently. As a result, a lack of image density is occurred in the recess portion. Further, if the time average value of the secondary transfer bias Vave [V] is not set to a large value to some extent, it is not possible to transfer a sufficient amount of the toner to the protruding portions on the surface of the recording paper. Accordingly, a lack of the image density is occurred on the protruding portions. In order to obtain a sufficient image density at both portions, the recess and protruding portions, on the surface of the recording paper. Further, in order to make the time average value Vave [V] and the return peak value Vr a large value, respectively, it is required to set a voltage Vpp between the return peak value Vr and the transfer direction peak value Vt, which is a width between the maximum voltage and minimum voltage, (hereinafter, referred to peak to peak voltage) to a relatively large value. This means that the transfer direction peak value Vt is also made a relatively large value inevitably. The transfer direction peak value Vt corresponds to the maximum voltage difference between the nip forming roller 536 which is grounded and the secondary transfer back roller 533 to which the secondary transfer bias is applied. Accordingly, if the value is large, it increases the possibility to occur the discharge between the rollers. Particularly, it tends to cause white spots on the image at the recess by causing the discharge in micro voids formed in the region between the intermediate transfer belt and the recess on the surface of the recording paper. Thus, it is found that it tends to cause white spots on the image at the recessed portions of the surface of the recording paper when the peak to peak voltage Vpp is set to a relatively large value to obtain a sufficient image density both at the recesses and protrusion portions of the surface of the recording paper.

Figure 18:
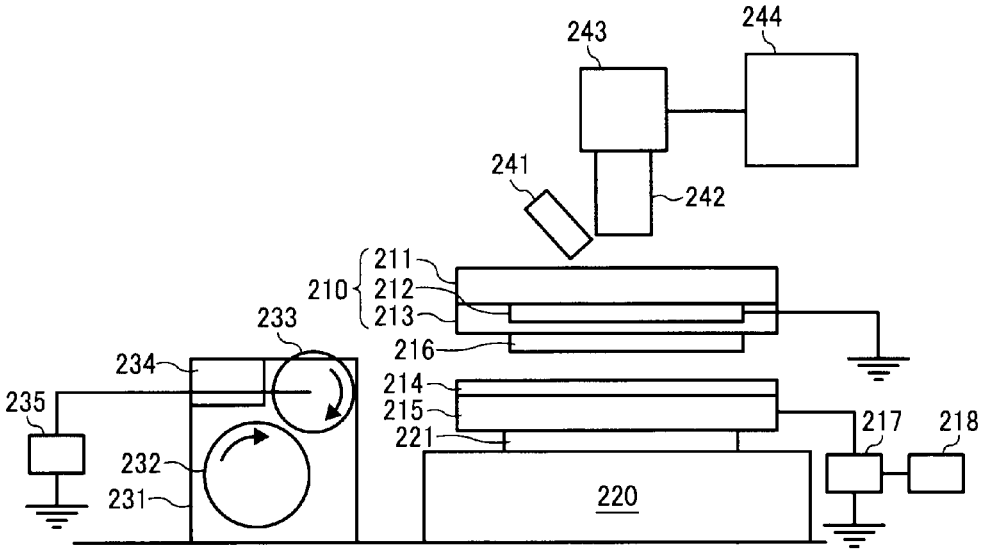
FIG. 18 is a schematic diagram showing an experimental observation apparatus.

Next, the experimental observation performed by the present inventors is described in detail. The present inventors fabricate a special experimental observation equipment to observe the behavior of the toner in the secondary transfer nip N. FIG. 18 is a schematic diagram showing the experimental observation equipment. This experimental observation apparatus includes a transparent base 210, a developing unit 231, a Z-stage 220, a lighting 241, a microscope 242, a high speed camera 243, and a personal computer 244, etc. The transparent base 210 includes a glass plate 211, a transparent electrode 212 consisting of ITO (Indium Tin Oxide) formed on the underside of the glass plate 211, a transparent insulating layer 213 formed of a transparent material coating on the transparent electrode 212. This transparent base 210 is supported at a predetermined height by a base support means (not shown). The base supporting means is configured to be movable in the vertical and horizontal directions in FIG. 18 by a movement mechanism, not shown. In the example illustrated, a transparent base 210 is provided on the Z stage 220 on which a metal plate 215 is mounted. It is also possible to move to a position directly above the developing device 231 disposed at the side of the Z stage 220 by moving the base support means. Further, the transparent electrode 212 of the transparent base 210 is connected to the electrode fixed to the base supporting means, and the electrode is grounded.

The developing device 231 has the same configuration as that of the developing unit of the printer according to the embodiment, and includes a screw member 232, a developing roller 233, and a doctor blade 234. The developing roller 233 is driven to rotate in a condition in which a developing bias is applied by the power supply 235.

The transparent base 210 is moved at a predetermined speed by moving the base supporting means to a position above the developing unit 231 and opposite to the developing roller 233 through a predetermined gap, the toner on the developing roller 233 is transferred onto the transparent electrode 212 on the transparent base 210. Thus, the toner layer 216 having a predetermined thickness is formed on the transparent electrode 212 on the transparent base 210. The toner adhesion amount per unit area for the toner layer 216 can be adjusted by the toner density of developer, the toner charge amount, developing bias value, a gap between the base 210 and the developing roller 233, the moving speed of the transparent base 210, and the rotation speed of the developing roller 233.

The transparent base 210 on which the toner layer 216 is formed, is moved to a position opposite to the recording paper 214 which is attached on a flat metal plate 215 with an adhesive conductive paste. The metal plate 215 is disposed on the base 221 having a load sensor (not shown), and the base 221 is disposed on the Z stage 220. Further, the metal plate 215, is connected to a voltage amplifier 217. To the voltage amplifier 217, a transfer bias consisting of a DC voltage and an alternating voltage is input from the waveform generator 218, and the amplified transfer bias voltage is applied to the metal plate 215 by the amplifier 217. When the metal plate 215 is lifted up by performing a drive control of the Z stage 220, the recording paper 214 begins to contact with the toner layer 216. When the metal plate 215 is lifted up further, the pressure for the toner layer 216 is increased, however, it is controlled so that the metal plate 215 stops being lifted up so as to have a predetermined value with the output value of the load sensor. Under a condition with a predetermined value of the pressure, the behavior of the toner is observed by applying the transfer bias to the metal plate 215. After the observation, the metal plate 215 is lowered by driving the Z stage 220 to separate the recording paper 214 from the transparent base 210. Then, the toner layer 216 is transferred onto the recording paper 214.

The observation of the behavior of the toner is carried out using a high speed camera 243 and the microscope 242 disposed above the transparent base 210. Since the transparent base 210 is formed of the layers of transparent materials, such as a glass 211, a transparent electrode 212 and a transparent insulating layer 213, it is possible to observe the behavior of the toner at the bottom side of the transparent base 210 from above the transparent electrode 210 through transparent base 210.

As the microscope 242, the zoom lens VH-Z75 manufactured by Keyence is used. As the high-speed camera 243, FASTCAM-MAX 120KC manufactured by Photron is used. The Photron's FASTCAM-MAX 120KC is driven and is controlled by the personal computer 244. The microscope 242 and the high-speed camera 243 are supported by camera support means (not shown). This camera support means is configured so that the focus of the microscope 242 is adjusted.

The behavior of the toner on the transparent base 210 is captured in the following way. First, a light is irradiated at a position for observing the behavior of the toner by a lighting 241, and the focus of the microscope 242 is adjusted. Then, the transfer bias is applied to the metal plate 215 so that the toner of the toner layer 216 attached to the lower side of the transparent base 210 is moved toward the recording paper 214. At this time, the behavior of the toner is captured by the speed camera 243.

The configuration of the transfer nip in the experimental observation equipment shown in FIG. 18 differs from that in the printer according to the embodiment. Accordingly, the transfer electric field acting on the toner differs from each other, even if transfer bias voltages are equal to each other. To determine the appropriate observation condition, in the experimental observation equipment, the transfer bias condition to obtain a good reproducibility to get a predetermined density in the recessed portions are investigated. As the recording paper 214, a FC WASHI type paper (Japanese paper) called "SAZANAMI" manufactured by NBS Ricoh Inc. is used. The toner formed by mixing a small amount of K toner in the Y toner having the average particle size 6.8[μm] is used. Since the experimental observation equipment is configured to apply a transfer bias to the back surface of the recording paper ("SAZANAMI"), the polarity of the transfer bias which can transfer the toner to the recording paper is the reverse to that in the printer according to the embodiment (that is the positive polarity). As the AC component of the secondary transfer bias consisting of the superimposed bias, an AC component having a sinusoidal waveform is used. The frequency f of the AC component is set to 1000[Hz], the DC component (in this example, it corresponds to the time average value Vave) is set to 200[V], and the peak to peak voltage Vpp is set to 1000[V]. The toner layer 216 is transferred with the toner adhesion amount between 0.4 and 0.5[mg/cm2] for the recording paper 214. As a result, it becomes possible to obtain a sufficient image density on the surface of the recess portions of "SAZANAMI".

At that time, the microscope 242 is adjusted to focus on the toner layer 216 on the transparent base 210 and, a picture of the behavior of the toner is captured. Then, the following phenomenon is observed. That is, the toner particles in the toner layer 216 move back and forth between the transparent base 210 and the recording paper 214 by an alternating electric field formed by the AC component of the transfer bias. With an increase of the number of reciprocations, the amount of the toner particles which move back and forth is increased.

Figure 19:
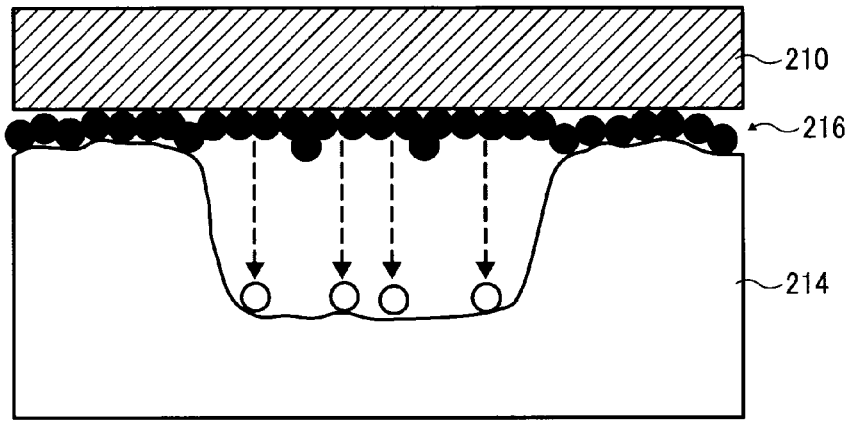
FIG. 19 is an enlarged schematic diagram showing behavior of the toner in the secondary transfer nip at the initial stage of a transfer process.
Figure 20:
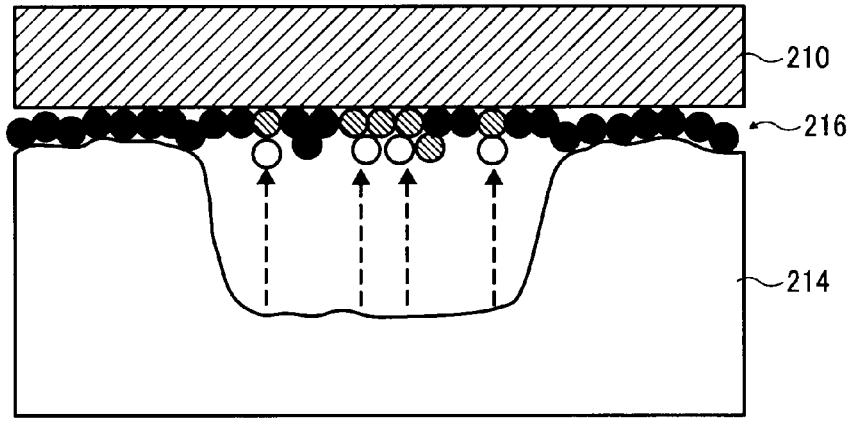
FIG. 20 is an enlarged schematic diagram showing the behavior of the toner in the secondary transfer nip at an intermediate stage of the transfer process.
Figure 21:
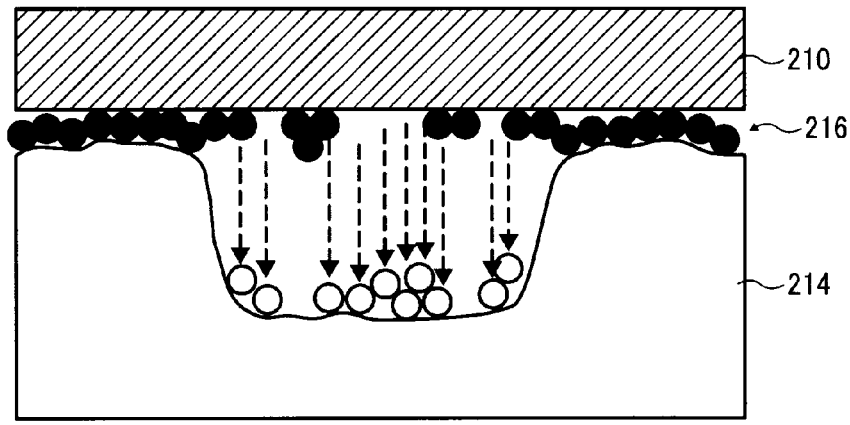
FIG. 21 is an enlarged schematic diagram showing the behavior of the toner in the secondary transfer nip at the final stage of the transfer process.

More specifically, at the transfer nip, the alternating electric field acts one time in each one cycle of the AC component of the secondary transfer bias (1/f) so that the toner particles move back and forth one time between the transparent base 210 and the recording paper 214. At the first cycle, as shown in FIG. 19, only the toner particles which are present on the surface of the layer of the toner layer 216 leave from the layer. Then, after entering in the recess portions of the recording paper 214, the toner particles come back again to the toner layer 216. In this case, the returned toner particles collide against the toner particles in the toner layer 216 to make the adhesion strength of the toner particles in the toner layer 216 between the toner layer 216 and the transparent base 210 weak. Accordingly, at the next cycle, as shown in FIG. 20, more toner particles than those in the previous cycle are separated from the toner layer 216. Then, after entering in the recess portions of the recording paper 214, the toner particles come back again to the toner layer 216. In this case, the returned toner particles collide against the toner particles in the toner layer 216 to weaken the adhesion strength of the toner particles in the toner layer 216 between the toner layer 216 and the transparent base 210. Further, with this process, at the next cycle, as shown in FIG. 21, more toner particles than those in the previous cycle are separated from the toner layer 216. Thus, each time the toner particles reciprocates, the number of the toner increases gradually. Then, it is found that a sufficient amount of toner is transferred in the recess portions of the recording paper P when the nip transit time is elapsed (in the experimental observation equipment, when a time corresponding to the nip transit time passes).

Next, the DC voltage (in this example, it corresponds to the time average value Vave) is set to 200[V] and the peak to peak voltage value Vpp between both the negative side and the positive side of the bias in a period (in this example, the transfer direction and the return direction) is set to 800[V].

Under such condition, when the picture of the behavior of the toner is captured, the following symptoms are observed.

That is, the toner particles being present on the surface of the layer among the toner particles in the toner layer 216 leave from the layer and enters into the recess portions of the recording paper P at the first period. However, the toner particles which entered in the recess portions stay therein without going toward the toner layer 216. And at the following cycle, the toner particles which leave from the toner layer 216 and enter in the recess portions of the recording paper P newly is a small number. Accordingly, when the nip transit time elapses, only a small amount of toner particles are transferred in the recess portions of the recording paper P.

The present inventors have performed further observation experiment. And, it is found that the return peak value Vr which can pull the toner entering in the recess portions of the recording paper P in the first cycle back again to the toner layer 216 depends on the toner adhesion amount per unit area on the transparent base 210. More specifically, the greater the amount of toner attached on the transparent base 210 is, the larger the returns peak value Vr which can pull the toner particles in the recess of the recording paper 213 back to the toner layer 216 is.

The distinctive configuration of the printer is described.

Figure 22:
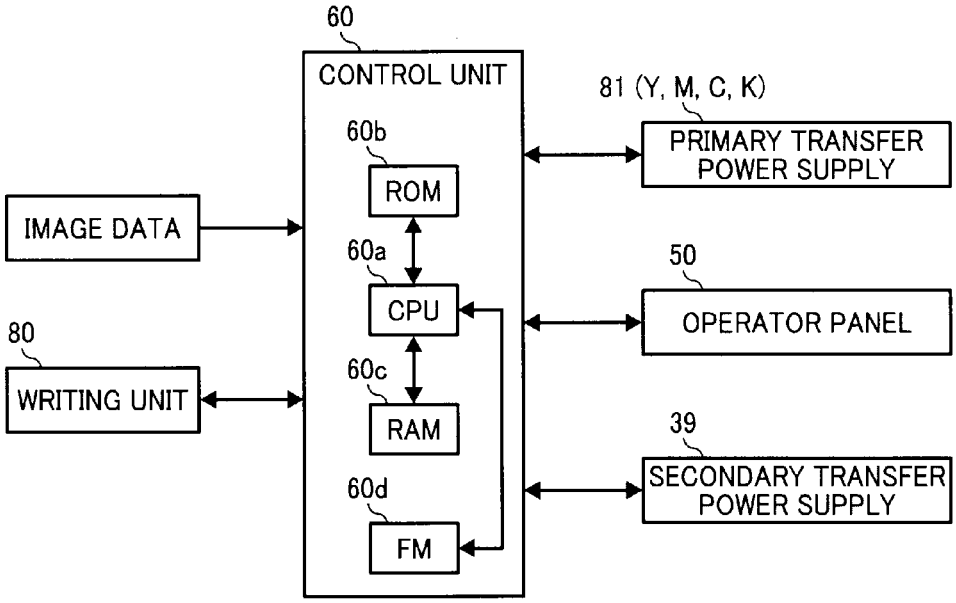
FIG. 22 is a block diagram showing the control system of the printer shown in FIG. 7.

FIG. 22 is a block diagram showing a part of the control system of the printer shown in FIG. 7. In FIG. 22, the control unit 60 forms a part of a transfer bias output means and includes a CPU 60*a* that is an computing means (Central Processing Unit), a RAM 60*c* (Random Access Memory), a ROM 60*b* that is a temporary storage (Read Only Memory), such as a flash memory 60*d* that is a non-volatile memory. To the control unit 60 which controls the entire system of the printer, a variety of devices and sensors are connected to communicate electrically. In FIG. 22, only the distinctive configuration of the printer and the related devices therefor are shown.

The power supply 81 for primary transfer (Y, M, C, and K) outputs primary transfer biases to apply to the primary transfer rollers 35Y, 35M, 35C, and 35K, respectively. The power supply 39 for secondary transfer (Y, M, C, and K) outputs voltages to supply to the secondary transfer nip N.

In this embodiment, a secondary transfer bias which is a voltage to be applied to the secondary transfer back roller 33 is output. This power supply 39 forms the transfer bias output means together with the control unit 60. The operation panel 50 is formed of, for example, a touch panel (not shown) and several key buttons, and images can be displayed on the screen of the touch panel. The input information can be transmitted to the control unit 60 by accepting input operation through the key buttons and the touch panel by an operator. Further, the operation panel 50 can also display images on the touch panel based on a control signal sent from the control unit 60.

The studies the present inventors have conducted using the present embodiment will be described below referring to the accompanying drawings.

The developer used in the present embodiment is formed of the toner having an average toner particle size of 6.8 μm (polyester) and plastic carriers having an average particle diameter of 55 μm.

Setting the AC transfer conditions for the uneven paper

The transfer bias condition required to obtain a good image on the uneven paper is to satisfy the conditions below 1, 2 and 3 as described above:

1. Minimum required peak value Vr;
2. Time average voltage Vave having a sufficiently large absolute value; and
3. The feeding peak value below a discharge starting voltage Vt.

Among these three conditions, it is the most important condition to ensure the time average voltage Vave in the AC component of the secondary transfer bias to have a sufficiently large absolute value. The reason for that becomes clear from the experiments performed by the present inventors. More specifically, when the toner is transferred to the recording material having an uneven surface, transfer performance to transfer more toner both to the recessed portions and the protruding portions depends on the time average value Vave, and may not be affected directly by the minimum required peak value Vr and the feeding peak value Vt. On the other hand, since the gap between the intermediate transfer belt 31 and the recessed portions are large, transfer performance to transfer many toner to the recessed portions drops down dramatically if the minimum required peak value Vr is not exceeding a predetermined value, however, if the minimum required peak value Vr can be kept to have a value larger than a predetermined value, transfer performance depends on the time average voltage Vave similarly to the case for the protruding portion.

In the present invention, it essentially requires that the time average voltage value Vave of the AC component of the secondary transfer bias is a voltage at the transfer side from an intermediate value halfway between the maximum value and the minimum value of the AC component (the center value between the maximum voltage value and the minimum voltage values) Voff. To achieve such condition, it is necessary to make a wave in which the wave area in the return direction side is smaller than the wave area of transfer direction side crossing the intermediate value of the AC component Voff. The time average value is the average voltage during time, which is an integral over one period of the voltage waveform divided by the length of the period.

Thus, it requires to have the minimum required peak value Vr and a sufficient time average value Vave to transfer the toner successfully to the recording material having an uneven surface. However, when a symmetrical sine wave or a square wave which have the time average value Vave equal to the center voltage value Voff is used, the absolute value of the feeding peak Vt is determined to a large value immediately when the time average value Vave and the peak value Vr are set, thereby, generating the white spots.

Therefore, using the waveform which has the time average value Vave at the transfer voltage side for the intermediate value Voff, (a larger wave in the minus side in this example), it is possible to obtain the required peak value Vr and a sufficient time average Vave, while keeping the feeding peak value Vt small.

Figure 23:
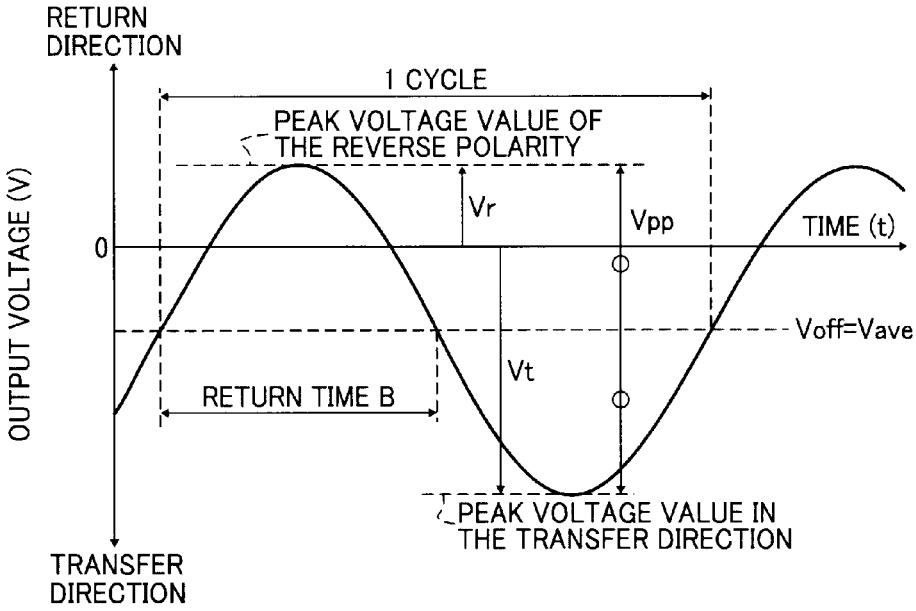
FIG. 23 is a waveform of the secondary transfer bias voltage output from the power supply in a comparative example 1.

As a form to achieve the above, for example, as shown in FIG. 23, the rising and falling slopes of the voltage at the return direction side may be made smaller than those slopes at the transfer direction side. Further, as an indication to indicate the relationship between the center voltage Voff and the time average voltage value Vave, the ratio of the area in the return direction side from the center voltage Voff to the total area of the AC waveform is defined as the return time [%].

Next, experiments that the present inventors have conducted and the further distinctive configuration of the printer according to an embodiment will be described.

Experiment 1

The present inventors prepare a test printing machine which has a configuration similar to the printer according to the embodiment. And various printing tests are carried out using this test printing machine. The process linear velocity that is the linear velocity of an intermediate transfer belt 31 and the photoreceptor is set to 176[mm/s]. Further, the frequency f of the AC component of the secondary transfer bias frequency is set to 500[Hz]. Further, as the recording paper P, Leathac 66 (product name) manufactured by Tokushu Paper Mfg. Co., Ltd. Paper 175 kg (YonRoku Ban Renryo, (four sixth version volume) is used. The Leathac 66 has a larger surface roughness than "SAZANAMI". The depth of the recessed portions of the paper surface is up to about 100[μm]. The blue solid image formed by superimposing M solid images and C solid image are output on the Leathac 66 under a variety of secondary transfer bias conditions. Experimental conditions of the secondary transfer bias are shown below. Further, the tests are carried out under an environment of the temperature of 10° C. and the humidity of 15%.

Further, as for the power supply 39 to generate a voltage, a function generator (FG300 Yokogawa Electric Corporation) is used to create a waveform, and the voltage is amplified by a factor 1000 by an amplifier (Trek High Voltage Amplifier Model 10/40). The blue solid images output in both the recess and protruding portions are evaluated with the criteria below. The evaluation results obtained under various peak to peak voltages Vpp and time average values Vave as shown in Table. 3 are shown in FIGS. 33 through 41.

TABLE 3

| duty ratio return time | 50% Sine wave | 40% Trapezoidal-Trapezoidal | 32% | 16% | 8% | 4% |
|---|---|---|---|---|---|---|
| Frequency [Hz] | 500 | 500 | 500 | 500 | 500 | 500 |
| Vpp [kV] (10 C. 15%) | 8 to 18 kV 2 kV step | same as the left | same as the left | same as the left | same as the left | same as the left |
| Vave [kV] (10° C. 15%) | −4 to 5.4 | −4.2 to −6.2 | −4 to −6.6 | −4 to −7 | −4.2 to −7.6 | −4.4 to −6.6 |

The image density of the blue solid image output in recess portions on the paper surface under the above conditions is evaluated by the following way:

Rank 5: the recessed portions are completely buried with the toner;

Rank 4: the recessed portions are almost buried with the toner, however, the paper texture is slightly visible at the recessed portions having a large depth;

Rank 3: Paper texture can be seen clearly at the recessed portions having a large depth:

Rank 2: worse than the rank 3, and better than the rank 1 described below; and

Rank 1: the toner is not adhered at all in the recess portion.

Further, the image density of the black solid image output in protruding portions on the paper surface is evaluated by the following way:

Rank 5: no unevenness of the image density, a fine image density is obtained;

Rank 4: Despite having a density unevenness slightly, a good image density is obtained even at the thin portions;

Rank 3: there is a density unevenness, a lack of the image density acceptable level at the thin portions;

Rank 2: worse than the rank 3, and better than the rank 1 described below; and

Rank 1: a lack of the image density, not acceptable level.

Then, the evaluation results of the image density in the recess, and the evaluation results of the image density on the protruding portions are summarized as follows.

A: Both the evaluation results of the image density on the recessed portions and protruding portion are equal to or higher than rank 5;

B: Both the evaluation results of the image density on the recessed portions and protruding portions are equal to or higher than rank 4;

C: Either one of the evaluation results of the image density on the recessed portions or protruding portions are equal to or below rank 3; and D: Both the evaluation results of the image density on the recessed portions and protruding portions are equal to or below rank 3.

The tests are carried out under the environment of the temperature of 10° C. and the humidity of 15%. As for the power supply, a function generator (FG300 Yokogawa Denki) is used to create a waveform of the bias voltage, and the bias voltage is amplified by an amplifier (Trek High Voltage Amplifier Model 10/40) by a factor of 1000 to apply to the secondary transfer back roller 33.

The evaluation results are shown in FIGS. 33 through 41, where both "A" and "B" are simply represented by "B" at both the recess and the protruding portions.

Description of the AC Wave

Comparative Example 1

This is a case in which a conventional sinusoidal wave is used as the AC component described in FIG. 17, FIG. 23 shows the waveform of the comparative example. In the comparative Example 1, the return time is set to 50%, and the result in this condition is shown in FIG. 33. As for all of the peak to peak voltage value Vpp and the time average value Vave shown in FIG. 23, the center voltage of the AC component Voff is equal to the time average value Vave.

Embodiment 1

Figure 24:
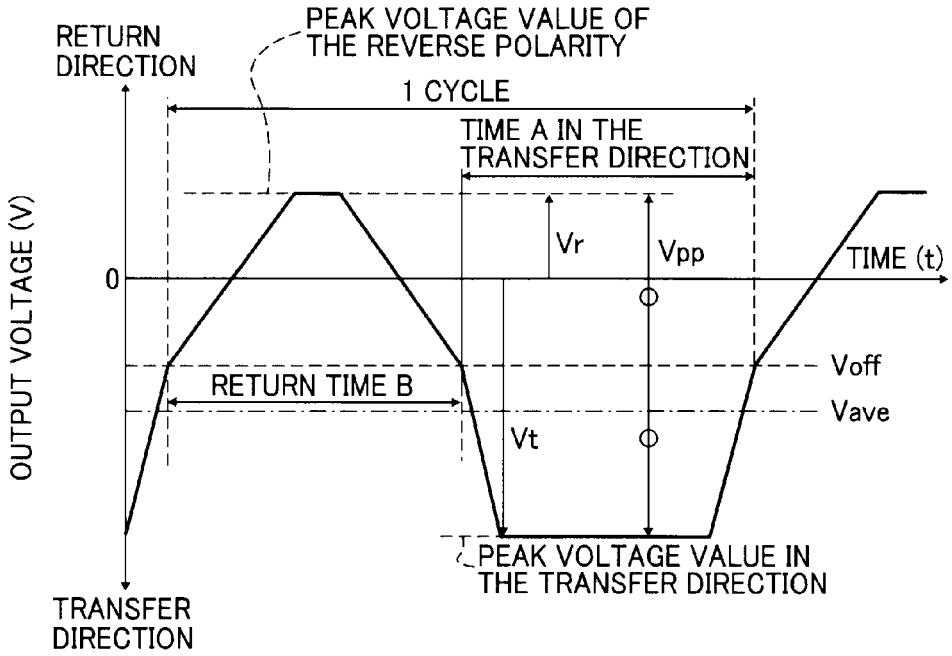
FIG. 24 is a waveform of the secondary transfer bias voltage output from the power supply in an embodiment 1.

As an AC component, the slopes of rising portions and the falling portions of the voltage in the return direction are set smaller than the slopes of rising portions and the falling portions of the voltage in the transfer direction. More specifically, when a time of the voltage output in the transfer direction for the center voltage Voff is defined as A, and a time of the voltage output in the direction reverse to the transfer direction for the center voltage Voff is defined as B, which is the return time, it is set to be A>B. FIG. 24 shows the waveform of such a case. When the return time is set to 40%, the result is shown in FIG. 34.

At this time, the peak to peak voltage value Vpp in FIG. 34 is Vpp=12 kV. When the time average value Vave, Vave=−5.4 kV, the center voltage of the AC component is Voff=−4.0 kV voltage.

Embodiment 2

Figure 25:
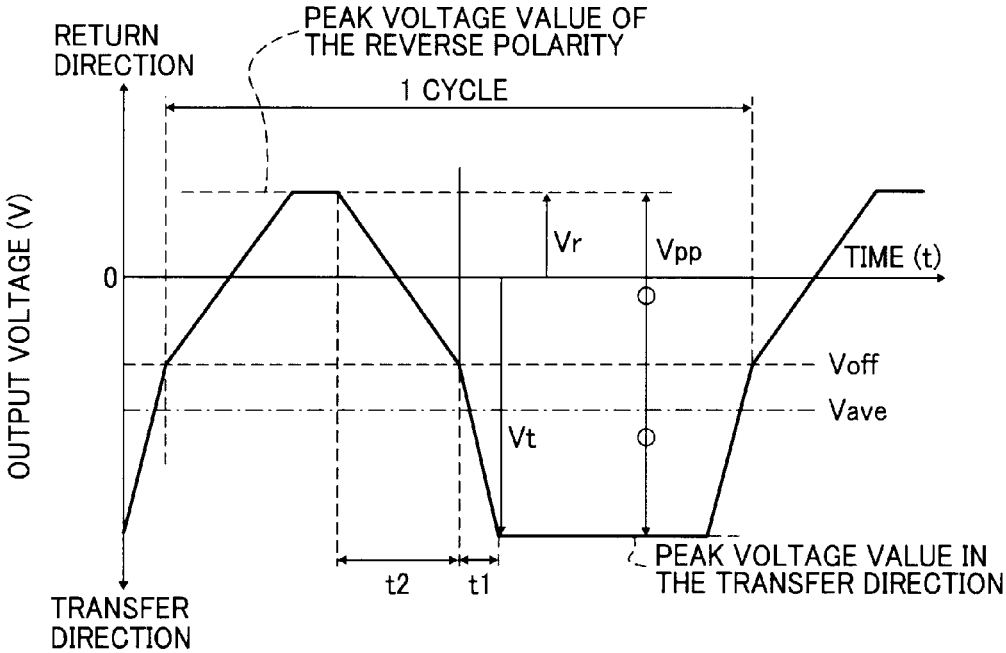
FIG. 25 is a waveform of the secondary transfer bias voltage output from the power supply in an embodiment 2.

As an AC component, the slopes of rising portions and the falling portions of the voltage in the return direction is set smaller than the slopes of rising portions and the falling portions of the voltage in the transfer direction. In this case, as for the waveform of the output voltage, when the time moving from the center voltage Voff to the peak voltage in the transfer direction is defined as t1, and the time moving from the peak voltage reverse to the peak voltage in the transfer direction to the center voltage Voff to is defined as t2, it is expressed as t2>t1. FIG. 25 shows the waveforms in this case. The result is shown in FIG. 34 where the return time is 40%. With this way, the time average value Vave can be set in the transfer direction for the center voltage Voff between the maximum and minimum values.

Embodiment 3

Figure 26:
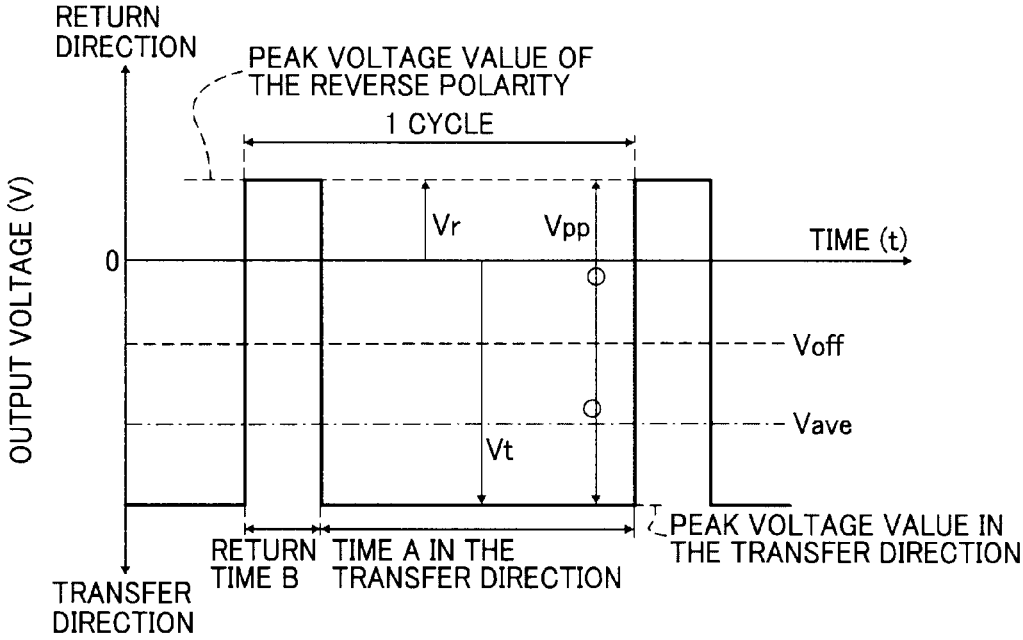
FIG. 26 is a waveform of the secondary transfer bias voltage output from the power supply in an embodiment 3.

As another way to get a wave which has a smaller area in the return direction than that in the transfer direction with respect to the center of the AC component Voff, there is a procedure in which the return time B in the return direction is made shorter than the time in the transfer direction A as shown in FIG. 26. With this way, it is possible to make the return time B smaller than the time in the transfer direction A.

Embodiment 4

Figure 27:
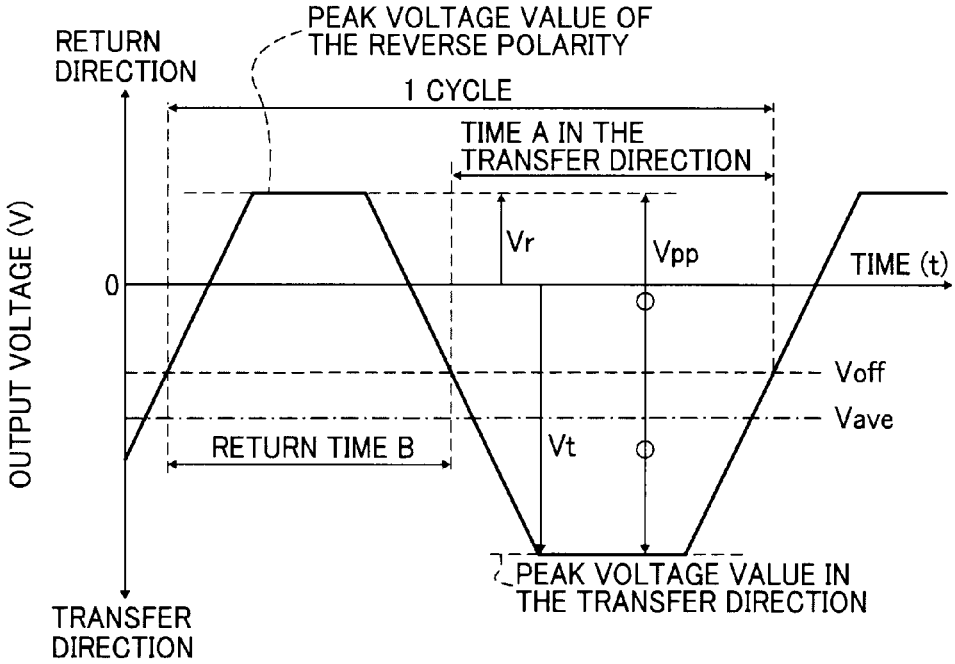
FIG. 27 is a waveform of the secondary transfer bias voltage output from the power supply in an embodiment 4.

As the AC component, the return time B is made shorter than the time in the transfer direction A. FIG. 27 shows the waveform in this case, and the result is shown in FIG. 35 where the return time is 45%.

Embodiment 5

Figure 28:
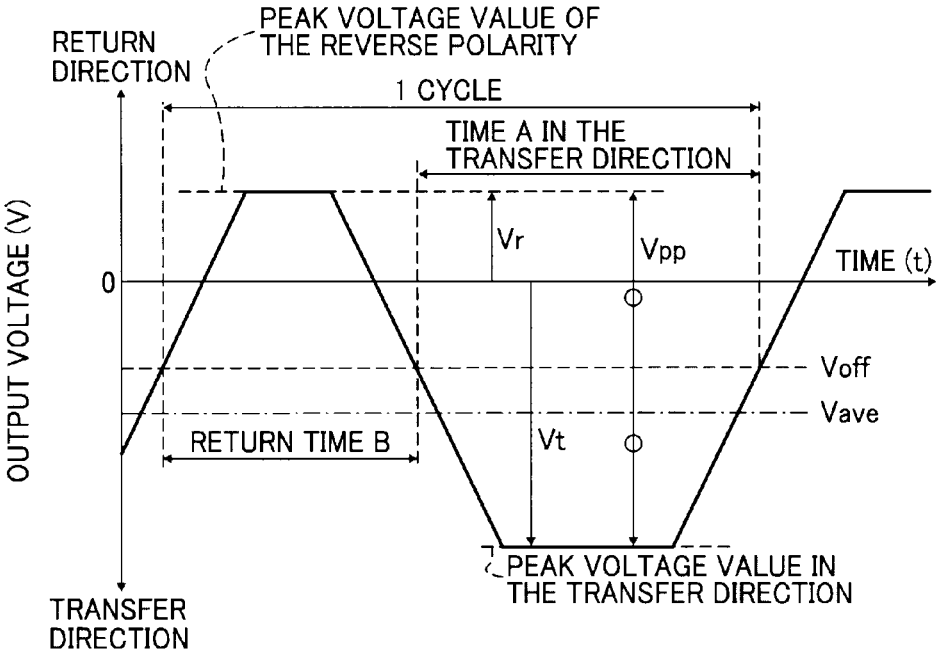
FIG. 28 is a waveform of the secondary transfer bias voltage output from the power supply in an embodiment 5.

As the AC component, the return time B is made smaller than the time in the transfer direction A. FIG. 28 shows the waveform in this case, and the result is shown in FIG. 36 where the return time is 40%.

Embodiment 6

Figure 29:
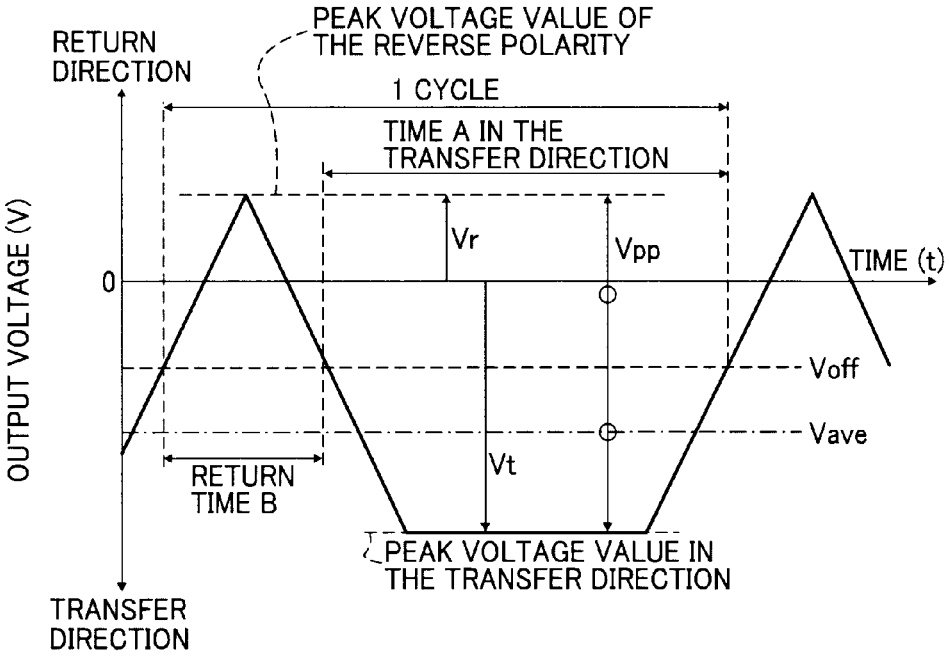
FIG. 29 is a voltage waveform of the secondary transfer bias voltage output from the power supply in an embodiment 6.

As the AC component, the return time B is made smaller than the time in the transfer direction A. FIG. 29 shows the waveform in this case, and the result is shown in FIG. 37 where the return time is 32%.

Embodiment 7

Figure 30:
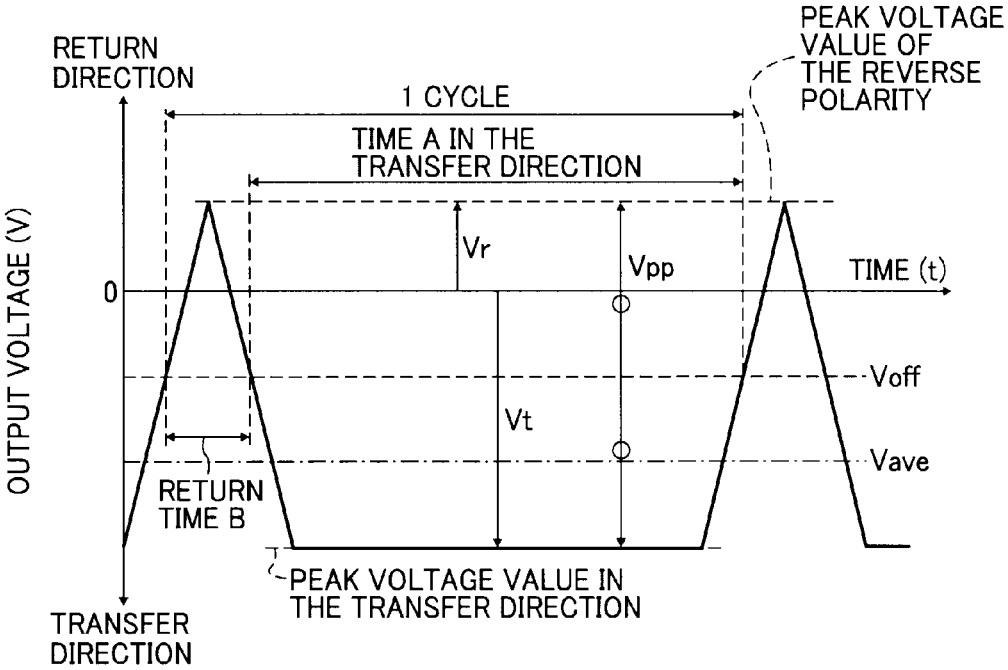
FIG. 30 is a waveform of the secondary transfer bias voltage output from the power supply in an embodiment 7.

As the AC component, the return time B is made smaller than the time in the transfer direction A. FIG. 30 shows the waveform in this case, and the result is shown in FIG. 38 where the return time is 16%.

Embodiment 8

Figure 31:
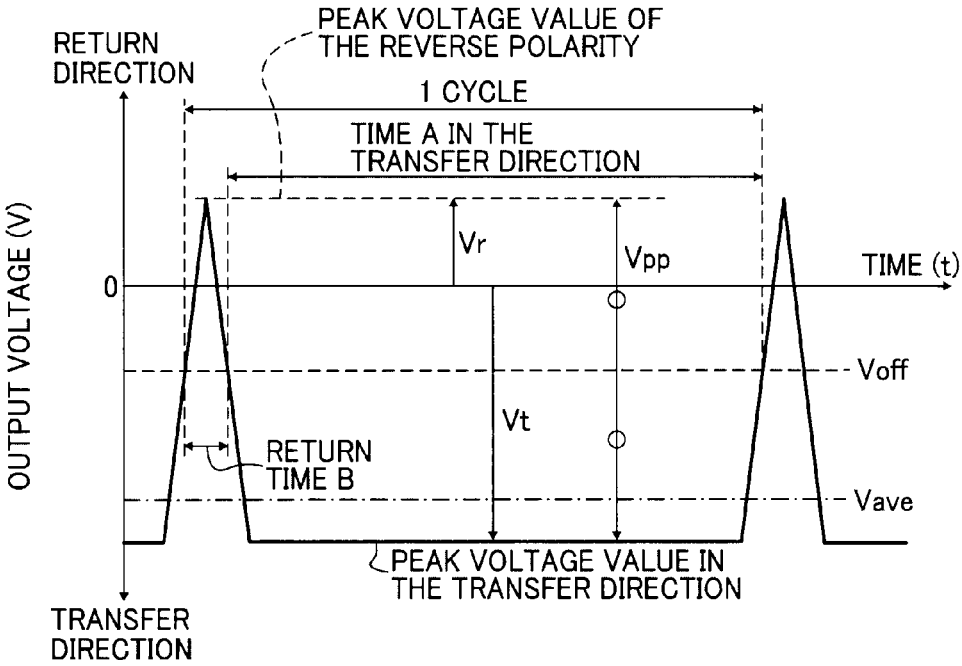
FIG. 31 is a waveform of the secondary transfer bias voltage output from the power supply in embodiments 8 and 9.

As the AC component, the return time B is made smaller than the time in the transfer direction A. FIG. 31 shows the waveform in this case, and the result is shown in FIG. 39 where the return time is 8%.

Embodiment 9

As the AC component, the return time B is made smaller than the time in the transfer direction A. Since the waveform in this case is identical to FIG. 31, it is omitted, and the result is shown in FIG. 40 where the return time is 4%.

Embodiment 10

Figure 32:
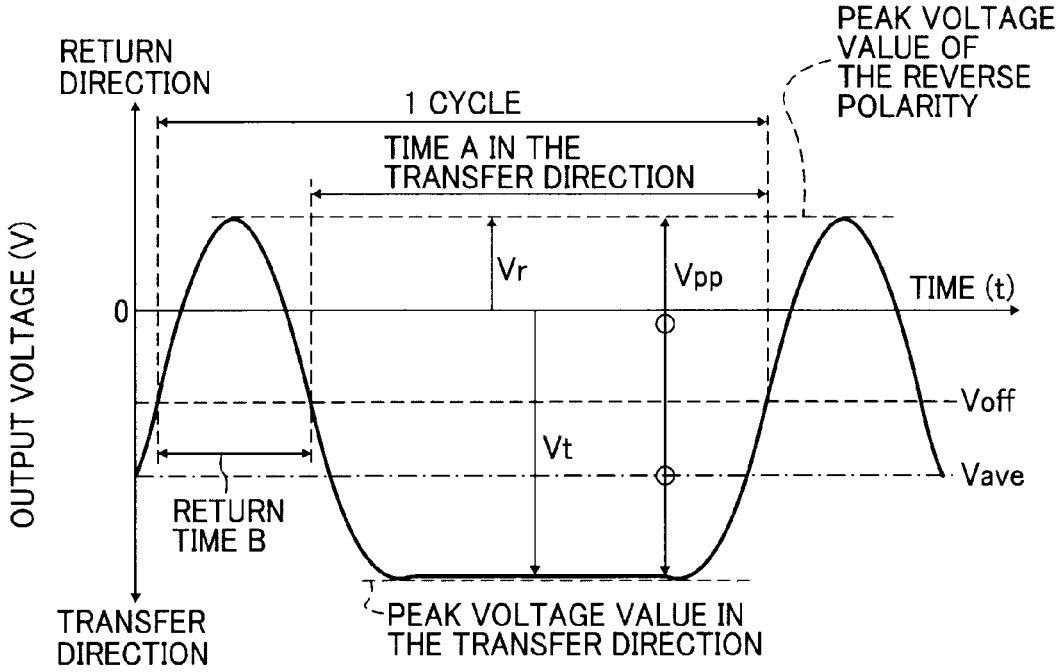
FIG. 32 is a waveform of the secondary transfer bias voltage output from the power supply in an embodiment 10.

As the AC component, the return time B is made smaller than the time in the transfer direction A, and the rounded waveform is used. FIG. 32 shows the waveforms in this case, and the result is shown in FIG. 41 where the return time is 16%.

In this case, in FIG. 41, the peak to peak voltage value Vpp is Vpp=12 kV. When the time average voltage Vave, Vave=−5.4 kV, the center voltage of the AC component is Voff=−2.4 kV voltage.

These voltage conditions vary depending on the resistance of the members related to the transfer nip, for example, the intermediate transfer belt 31, the nip roller 36, the secondary transfer back roller 33, the transfer paper, and the temperature and humidity conditions. Accordingly, there may be a deviation from the evaluation results shown in the FIGS. 33 through 41.

When the secondary transfer bias formed by superimposing an AC voltage on the DC voltage is used to transfer the toner image, it is found that there is a condition which does not cause the image unevenness periodically due to the alternating voltage.

Further, when the frequency of the alternating voltage is f[Hz], the linear velocity of the intermediate transfer belt 31 is v [mm/s], and the transfer nip width of the secondary transfer unit is d[mm], a time in which the image passes through the transfer nip is obtained as a value of the nip width divided by the linear velocity, that is d/v. When the cycle of the alternating voltage is 1/f[s], the number of the period of the alternating voltage applied during the transit time that the image passes through the nip is expressed by d×f/v. The condition which does not cause the periodic image unevenness is obtained to set a frequency whose number of the period of the alternating voltage is more than four times. Accordingly, as the frequency condition of an alternating voltage f, the frequency f is needed to follow the equation 1 below, $$f>(4/d)\times v \qquad \text{(equation 1).}$$

In this embodiment, when the image is evaluated at the frequency of 500 Hz, there is no generation of the periodic image unevenness.

Experiment 2

In the secondary transfer nip N, if a transfer current does not flow through the recording paper P in some extent, it is not possible to obtain a good transfer performance. And, of course, it is more difficult to flow the transfer current on the cardboard than the paper having an ordinary thickness. Further, it is desired to adhere the toner well both in the recess and the protruding portions of the surface of both the Japanese paper having an ordinary thickness and the WASHI, that is the thick Japanese paper. Accordingly, we have conducted experiment 2 to find an advantageous way and know how to control the secondary transfer bias to achieve a sufficient toner transfer.

As for the secondary transfer power source 39, a power source which outputs the peak to peak voltage Vpp of the AC component, and the offset voltage (Center voltage) Voff by a constant voltage control is used. Other conditions are as follows:

Process linear velocity v=282[mm/s];

Recording Paper Leathac 66 of 175 kg paper;

Test images: black solid image of A4 size;

Return time ratio=40[%];

The offset voltage (center voltage value) Voff: from 800 to 1800[V];

Peak to peak voltage Vpp: between 3 and 8[kV];

Frequency f=500[Hz]; and

Environmental conditions: 23° C., 50%.

The evaluation is performed using the ranks 1 through 5 as described above, and "A", "B", "C", and "D". Then, similar experiments have been conducted using the thicker paper Leathac 66 of 215 kg paper which is thicker than the Leathac 66 of 175 kg paper as the recording paper P, exchanging the Leathac 66 of 215 kg paper.

The experiments have been conducted for both Leathac 66 (175 kg paper) and Leathac 66 (215 kg paper) in all the combination of the offset voltage (center voltage value) Voff and the peak to peak voltage Vpp. Then, a condition which causes the result of "A" (the evaluation results of the image density at the recess and protruding portions are higher than rank 5) and the result of "B" (the evaluation results of the image density at the recess and protruding portions are higher than rank 4) is obtained. However, there is no condition which obtains the evaluation result of "A" for both papers. Further, there is a condition of the offset voltage and the peak to peak voltage with which the evaluation result obtains "B" for both papers. The condition is a combination of the peak to peak voltage value Vpp=6[kV] and the offset voltage (center voltage value) Voff=−1200±100[V] (central value±9%).

Experiment 3

In this experiment, the power supply 39 which outputs the offset voltage (center voltage value) Voff by a constant current control is used. The experiments have been conducted by setting the target output current value (offset current Toff) to a value between −30 and −70 μA, and setting the other conditions other than that similarly to Experiment 2. As a result, the combination of the offset current Ioff and the peak to peak voltage Vpp with which the evaluation result of "A" for both papers is obtained, and it is the condition of the peak to peak voltage value Vpp=7[kV] and the offset current (center current value) Ioff=−45±9[μA] (central value±20%).

The combination of the offset current Ioff and the peak to peak voltage Vpp with which the evaluation result is ○ is obtained for both papers is the condition of the peak to peak voltage value Vpp=7[kV] and the offset current (center current value) Ioff=−49±14[μA] (central value±29%).

Thus, there is no combination with which the evaluation result of "A" is obtained for both papers in Experiment 2. However, in the Experiment 3, there is a combination with which the evaluation results of "A" is obtained for both papers. Further, focusing on the combination to obtain the result of "B", in the experiment 2, it is the condition of the offset voltage (center voltage) Voff=−1200±100[V] (±9% central value). Whereas, in experiment 3, it is the condition of the offset current (center current value) Ioff=−49±14[μA] (central value±29%). Thus, the latter case has a wider numerical range obviously for the central value. The experimental results mean that it is possible to get a larger margin in setting the target control value which can accommodate the papers having a variety of thicknesses from the general paper to the cardboard when the constant current control is used, compared to the case when the DC component is controlled using a constant voltage control.

Therefore, in the printer according to an embodiment, a secondary transfer power supply 39 which outputs the DC component by controlling by a constant current control is used.

Further, the secondary transfer power supply 39 is configured to output the AC component of the peak to peak voltage by controlling by a constant current control also. According to this configuration, it is possible to generate effective return peak voltage and feeding peak voltage reliably by making the peak to peak voltage Vpp constant, regardless of environmental changes.

According to the result of each experiment, and at least based on the comparison between the comparative example 1 and the embodiment 1, it is found that the proper range to transfer the toner to the recording paper having an uneven surface is expanded dramatically when the time average value Vave of the secondary transfer bias voltage is a value in the transfer direction for the center voltage which is the intermediate value between the maximum and minimum values of a secondary transfer bias voltage. Because of achievement of the wide proper range for the toner transfer, it is possible to reduce the occurrence of white spot so that a good image can be obtained with a sufficient image density in the recessed portions and protruding portions of the surface of the recording material even when a variety of parameters such as the paper types, image patterns, and the environment condition changes.

Since the time average value Vave is set to a value in the transfer direction for the center voltage Voff, it is possible to ensure a sufficient return peak voltage Vr without increasing the transfer peak voltage in the transfer direction Vt which may cause a discharge so that the time average value Vave can be only increased. Accordingly, it is considered that the good result can be obtained.

According to the results of embodiments 1 through 8, it is possible to shorten the return time further by making the return time shorter than the transfer time so that it is possible to obtain a good image quality. In other words, it is possible to obtain a good image quality by setting the waveform output from the power supply 39 to satisfy the relation A>B, where an output time of the voltage in the transfer direction is A and an output time of the voltage having reverse polarity to that in the transfer direction is B.

Further, according to the results of Embodiment 9, when the return time is too small (but, wider than a sine wave), the proper range of the toner transfer becomes small. Accordingly, when the secondary transfer bias voltage is X and, it is desired that the waveform output from the power supply 39 is set so that the range of X satisfy the relation $0.10<X<0.40$ where $X=B/(A+B)$.

Experiment Related to Deteriorated Toner

Experiment 4

As a condition to obtain a uniform image in the recessed portions and the protruding portions of the recording material P under the environment of 10° C., 15%, it is selected that the frequency is 500 Hz, the duty ratio is (return time B) 16%, Vave=−6.6 kV, Vpp=14 kV, Vr=5.2 kV, Vt=−8.8 kV, and Voff=−1.8 kV. And, it is carried out to process the papers continuously under such a condition.

When a low image area rate image in which the image area occupies by a percentage lower than 5% on the image recording material P is output continuously, the image densities both in the recess and the protruding portions are gradually decreased and white missing image is occurred finally.

When the low image area ratio images are output continuously, the toner is not consumed in the developing unit so that various stresses are given to members and units in the image forming apparatus. Accordingly, for example, additives added to the surface of the toner are buried inside the toner or, separated from the toner so that the toner is deteriorated.

When the surface of the toner is coated with additives, the intermediate transfer belt 31 contacts the external additive. However, the particle size of the external additive is very small, therefore, the contact area between the intermediate transfer belt 31 and the toner is small. By contrast, when the external additive on the surface of the toner is buried or separated, the intermediate transfer belt 31 contacts the surface of the toner, however, since the toner particle size is sufficiently large compared to the external additive, the contact area between the toner and the intermediate transfer belt 31 is large. When the contact area is large, the adhesion force between the powder and the contact surface increases. Accordingly, the adhesion force between the intermediate transfer belt 31 and the deteriorated toner is greater than the adhesion force between the intermediate transfer belt 31 and the normal toner which is not deteriorated. When the adhesion force is increased because of the toner degradation, it is considered that transfer performance becomes worse because it becomes difficult that the toner separates from the intermediate transfer belt 31.

Then, when the optimum transfer conditions is examined again, using the conditions in Table 3, it is not possible to transfer the deteriorated toner by changing the duty ratio (return time B), Vpp, Vave, Vr, and Vt. Transfer performance becomes better when the frequency is increased, and it becomes possible to transfer well only at the 2000 Hz.

Next, the transfer bias is set to the duty ratio (return time B) same as that of the toner which is not deteriorated, that is 16%, Vave=−2.6 kV, Vpp=10.0 kV, transfer performance to the recessed portions of the recording material P is evaluated by changing the frequency by the increment step of 200 Hz from 400 Hz to 2000 Hz.

The transferred image is evaluated by five steps evaluation. The rank 5 is given if the toner is transferred to the recessed portions to obtain a sufficient image density. The rank 4 is given if the toner is slightly missing and slightly white missing pattern is observed in the recessed portions or, the image density at the recess portion is reduced slightly, but acceptable as the product. The rank 3 is given if the toner is missing to have a white missing pattern in the recessed portions compared to rank 4 or, the image density in the entire region is reduced, and not acceptable as the product. The rank 2 is given if there are more toner missing to have white missing pattern in the recessed portions compared to rank 3 or, the image density in the entire region is low. The rank 1 is given if white pattern is observed entirely in the recess portions, and the state of the groove is recognized clearly. Table 4 shows the evaluation results depending on the setting value of the frequency.

TABLE 4

| | Frequency (Hz) | | | | | | | | |
|---|---|---|---|---|---|---|---|---|---|
| | 400 | 600 | 800 | 1000 | 1200 | 1400 | 1600 | 1800 | 2000 |
| Transfer performance in recess portion | 3 | 3 | 4 | 4 | 5 | 5 | 5 | 5 | 5 |

As shown in Table 4, when the frequency is set higher, transfer performance in the recessed portions are improved. If the frequency is set to equal to and higher than 800 Hz, the image which is higher than rank 4 and is acceptable level as a product can be obtained. Thus, by increasing frequency of the alternating voltage which becomes the voltage, it is found that a high transfer performance at the recessed portions can be obtained even when the toner is deteriorated.

The increase in frequency is corresponding to the increase in the number of period times of the alternating voltage in the secondary transfer nip N. Based on the discussion above, it becomes clear that it is necessary to increase the number of periods to transfer the deteriorated toner.

Now, the reason for that is discussed.

The mechanism to obtain a high transfer performance of the toner in the recessed portions by the alternating field formed by switching between the voltage in the transfer direction to transfer the toner image from the intermediate transfer belt 31 to the recording material and the voltage having a polarity reverse to the voltage in the transfer direction when the toner image on the intermediate transfer belt 31 is transferred to the recording material P is considered to be due to the following reason.

When an alternating electric field is applied, a part of the toner on the intermediate transfer belt 31 is moved from the intermediate transfer belt 31 to the recessed portions of the recording material P by the electric field of the transfer direction to transfer the toner from the intermediate transfer belt 31 to the recessed portions of the recording material P that is the target material. The toner transferred to the recessed portions of the recording material P returns to the intermediate transfer belt 31 by the electric field in the return direction to move the toner from the recording material P to the intermediate transfer belt 31. Since the toner provides interactions such as electrostatic forces, mechanical forces, for example, collision or contact with the toner on the intermediate transfer belt 31, the toner adhesion state on the intermediate transfer belt is changed by these interactions. The toner which becomes easier to separate from the intermediate transfer belt 31 is transferred to the recessed portions by the electric field in the direction to move the toner from the recording material P to the intermediate transfer belt 31. However, the number of toner particles to transfer to the recessed portions increases, compared to the number of toner particles transferred at the beginning. This makes an increase in the number of toner particles to participate in the reciprocating motion when the number of the frequent cycle of the alternating electric field increases, resulting in improvement of the toner transfer performance to the recess portion.

When the adhesion force of the toner which is not deteriorated is small, it is easy to transfer the toner on the intermediate transfer belt 31, accordingly, the number of the toner to transfer increases sufficiently even if the number of reciprocating motion is small. However, when the adhesion force of the toner such as the deteriorated toner is large, it is not easy to transfer the toner on the intermediate transfer belt 31, accordingly, a lot of the reciprocating motions are needed to increase the toner to transfer with a sufficient number.

As described previously, the number of the period of the alternating voltage in the transfer nip is determined by the nip width, linear velocity, the frequency of the alternating voltage. Therefore, as a means to adjust by increasing or decreasing the number of periods, a method is to slow down the process line speed besides changing the frequency of the alternating voltage and the nip width which is determined by the configuration of the image forming apparatus.

Actually, transfer performance is evaluated under the condition of Vave=−2.6 kV and Vpp=10.0 kV as the transfer bias, at the frequency of 500 Hz, with the linear velocity of the intermediate transfer belt 31 from 176 mm/s to 88 mm/s, that is the half process linear velocity thereof. As a result, a good level is obtained with an acceptable image quality as a product of rank 4. Therefore, it is found that if the toner deterioration determination means 70 is employed, it is possible to change the number of period of the alternating electric field by controlling the rotational speed of the drive motor 40 based on the information of the toner deterioration determination means 70.

Next, it is confirmed whether or not there is a problem in the image in a case where the toner is not deteriorated when the number of the period of the alternating voltage in the secondary transfer nip N increases.

First, while the transfer bias is set to Voff=Vpp=10.0 kV, the frequency to 400 Hz, and the linear velocity to 176 mm/s, the solid images have been outputting continuously until the image with no white missing pattern is obtained.

Secondarily, the transfer bias is set to Voff=−2.6 kV, Vpp=10.0 kV, and keeping the linear velocity at 176 mm/s, while changing the frequency by increment of 200 Hz from 400 Hz to 2000 Hz, and a transfer performance of the mixed image including, letters, lines, a picture, etc. is evaluated.

As for the evaluation of transfer performance, the transferred image is evaluated by five steps on the toner scattering, which makes the image unclear by attaching the toner on the circumference of the letters and lines, and on the image density at the recess portion. For the image density at the recess portion, the similar evaluation criteria described previously is used. As for the toner scattering, the rank 5 is given if the image is fine, the rank 4 is given if the clearness is slightly degraded, but acceptable as the product, the rank 3 is given if the clearness is degraded, compared to rank 4 but acceptable as the product, the rank 2 is given if the clearness is degraded further, compared to rank 3 and not acceptable as the product, and the rank 1 is given if the image is not clear to identify. Table 5 shows the results of the evaluation of transfer performance depending on the setting of the frequency.

TABLE 5

| | Frequency (Hz) | | | | | | | | |
|---|---|---|---|---|---|---|---|---|---|
| | 400 | 600 | 800 | 1000 | 1200 | 1400 | 1600 | 1800 | 2000 |
| Transfer performance in recess portion | 5 | 5 | 5 | 5 | 5 | 5 | 5 | 5 | 5 |
| toner scattering | 4 | 4 | 3 | 3 | 3 | 3 | 2 | 2 | 2 |

As shown in Table 5, it is found that there is no problem on transfer performance in the recess portions at any frequency, but the level of the toner scattering is degraded with the increase of the frequency. Further, if the linear velocity is set to 141 mm/s, a deterioration of the toner scattering is observed even at the frequency of 400 Hz similarly to the case in which the transfer frequency is increased. Furthermore, when the linear velocity is made slow to increase the number of periods of alternating voltage in the secondary transfer nip N, there is a problem that the productivity of the image forming is reduced.

As described above, if the number of the period of the alternating voltage in the secondary transfer nip N is increased, it is possible to prevent the toner transfer performance in the recess from declining even when the toner is deteriorated. However, it is found that there are side effects, for example, toner scattering becomes worse when the toner is not deteriorated. The present inventors have investigated how to obtain a high transfer performance of the toner in the recessed portions with the deteriorated toner while reducing such side effects. Finally, the present inventors have devised a way to change the number of periods of alternating electric field in the secondary transfer nip N, based on the determining result of the toner deterioration.

When the toner is determined to be deteriorated based on the criteria for the toner deterioration, the number of the period of the alternating voltage in the secondary transfer nip N is set to a setting value for the deteriorated toner, and when the toner is determined not to be deteriorated based on the criteria for the toner deterioration, the number of the period of the alternating voltage in the secondary transfer nip N is set to a setting value for the normal toner which is not deteriorated. Using this procedure, the number of periods of alternating voltage which becomes a secondary transfer bias is increased only when it is determined that the toner is deteriorated, and it is set to the minimum required cycle when the toner is not deteriorated. Accordingly, it is possible to reduce the side effects such as worsening of the toner scattering.

That is, in this embodiment, outputting the information of the deteriorated toner, the number of periods of the alternating electric field is changed to a value larger than that when it is determined by the toner degradation determination means 70 that the toner is not deteriorated so that the power supply 39 is controlled to obtain the number of a predetermined periods appropriately. Further, it may be performed by controlling the toner deterioration determination means 70 to change the number of periods of alternating electric field so as to change the frequency of the alternating electric field which the power supply 39 forms.

Figure 42:
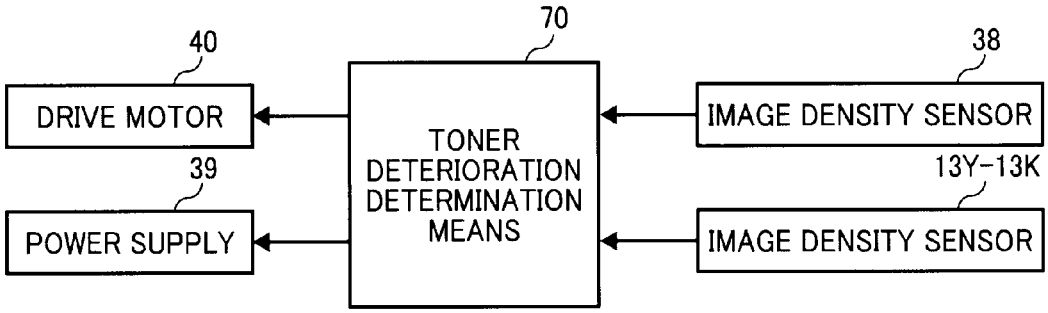
FIG. 42 is a block diagram showing a control system for changing an alternating electric field based on the toner deterioration determination.

The configuration of the control system according to the present embodiment is described, referring to FIG. 42.

The power supply 39, the image density sensor 38, the image density sensors 13Y, 13M, 13C, and 13K and the drive motor 40, are connected through signal lines to the toner deterioration determination means 70 which outputs the toner degradation information by determining whether or not the toner is deteriorated. The toner deterioration determination means 70 is formed of so called computer circuit, and an output of the mage density sensor 38 is input thereto and the toner density information measured by the image density sensors 13Y, 13M, 13C, and 13K are input thereto. Then, the deterioration state of the toner is determined from the toner density information input. Based on the determination result, it functions to change the number of periods of the alternating electric field in a secondary transfer nip N.

In the toner deterioration determination means 70, the threshold value Z1 for determining deterioration and the setting value T and T1 for changing the number of period of the alternating electric field are stored. The setting value T is used when the toner is not deteriorated, and the setting value T1 is used when the toner is deteriorated. The setting value T1 is set so as to increase the number of the period of the alternating electric field, therefore, the number is larger than that at the setting value T.

As another determination method of the toner deterioration, there is a method which installs a certain toner deterioration detection unit in the image forming apparatus to determine whether or not it satisfies a condition that is expected to be the toner deterioration. As the condition in which the toner is expected to be deteriorated, it is a stressed condition in which the toner receives stress for a long time without being consumed for forming a toner image in the image forming apparatus, more specifically, as shown in the embodiment, it is a case in which the image occupied by an actual image area less than a predetermined value has been output continuously for a predetermined time, or a predetermined number of such image has been output.

However, in reality, there are a variety of situations, for example, the number of continuous image output is less than a predetermined number, but, a low area image is output continuously frequently between the outputs of the image occupied by an actual image area with a high percentage. Thus, it is difficult to predict the toner deterioration. Accordingly, it is expected to be more accurate to determine the toner deterioration based on the detection information of the toner degradation detection means by providing it in the image forming apparatus.

As the toner degradation detection means 71, various examples shown in the patent applications can be applied. For example, in the patent applications listed below 1 through 5, the standard image pattern for the measurement is developed on the photoreceptor, and the transfer rate in the primary transfer process is measured by the various sensors so that the toner deterioration is detected by the change in transfer rate. Further, when the toner is deteriorated, the image density on the photoreceptor decreases due to the decrease of the developing performance of the toner. Therefore, the developing bias is raised to ensure the image density. When the image density cannot be kept at a predetermined level by increasing the developing bias, up to the upper limit of the developing bias, the deteriorated toner may be forced to develop and be output:

(1) Patent Publication No. 2007-304316;
(2) Patent Publication No. 2004-240369;
(3) Patent Publication No. 06-003913;
(4) Patent Publication No. 08-227201; and
(5) Patent Publication No. 2006-251409.

Figure 43:
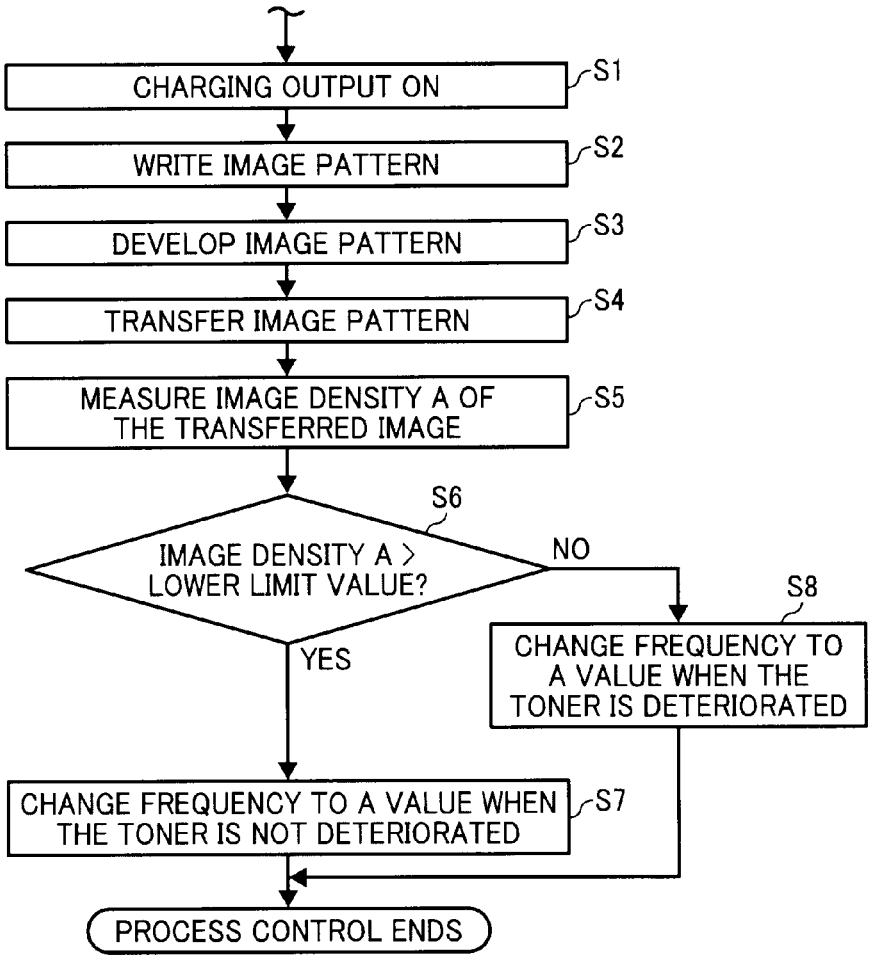
FIG. 43 is a flow chart showing steps in a control process for changing the alternating electric field based on the toner deterioration determination.

Therefore, in this embodiment, the method to determine whether or not the toner is deteriorated from the transfer rate at the primary transfer process is described. FIG. 43 shows a control flow chart in which deterioration of the toner is determined by the transfer rate to change the frequency of the AC voltage. This control is performed by the toner deterioration determination means 70.

In FIG. 43, in step S1, following the end of a known process control successively, the charging outputs are made on by controlling the power supplies of the charging devices 6Y, 6M, 6C and 6K. In step S2, the image pattern is written on each photoreceptor with the light amount corresponding to the image density set, and is developed in step S3.

The image pattern is transferred onto the intermediate transfer belt 31, in the step S4. The image density A of the transferred image is measured by the image density sensor 38, in step S5. In other words, the image density sensor 38 in this embodiment serves as the toner degradation detection means. In step S6, it is determined whether or not the image density is higher than the predetermined lower limit of the image density (threshold Z1), and when it satisfies the condition, it is determined that the transfer rate is not declined and the toner is not deteriorated, then, the process proceeds to step 7, and the frequency of the AC voltage is set to the setting value T which is the setting value when the toner is not deteriorated. Then, this process control ends. By contrast, when it does not satisfy the condition, it is determined that the transfer rate is declined and the toner is deteriorated, then, the process proceeds to step 8, and the frequency of the AC voltage is set to the setting value T1 which is the setting value when the toner is deteriorated so as to increase the frequency of the power supply 39. Then, this process control ends.

Figure 44:
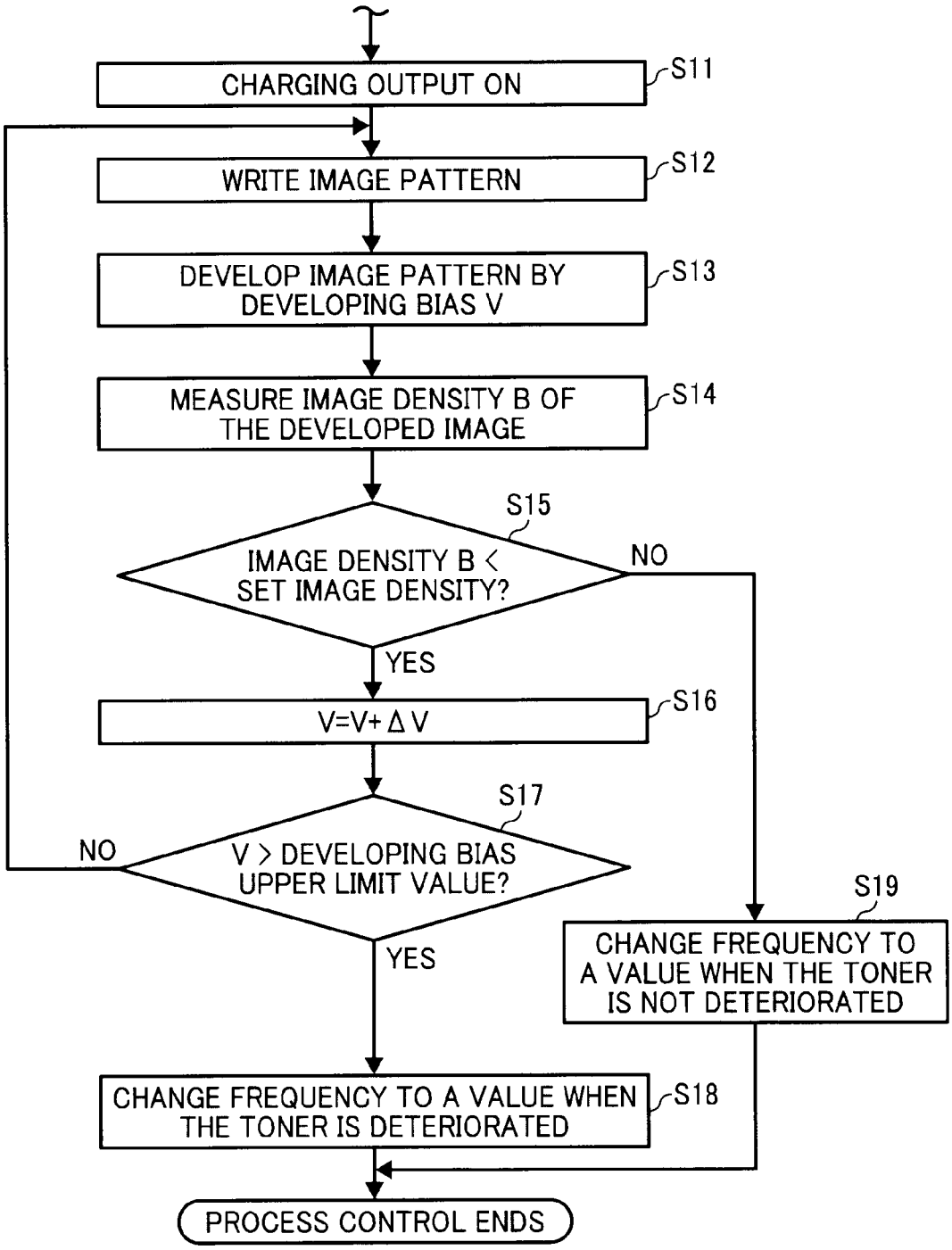
FIG. 44 is a flow chart showing steps in another control process for changing the alternating electric field based on the toner deterioration determination.

Next, the case to determine the deterioration of the toner from the image density on the photoreceptor 2Y, 2M, 2C and 2K is described. FIG. 44 shows the control flowchart in that case. This process control is performed by the toner deterioration determination means 70. In this embodiment, it is assumed that the threshold value Z2, setting values T2 and T3 are stored in the toner deterioration determination means 70. The setting value T2 is the setting value to be used when the toner is not deteriorated. The setting value T3 is the setting value to be used when the toner is deteriorated.

At the setting value T3, it is set that the number of the period of the alternating electric field is increased so that the number is larger than that of the setting value T2.

In FIG. 44, in step S11, following the end of a known process control successively, the charging output is made on by controlling the power supplies of the charging devices 6Y, 6M, 6C and 6K. In step S12, the image pattern is written on each photoreceptor with the light amount corresponding to the image density set, and is developed by the developing bias V in step S13. The image density B of the transferred image is measured by the image density sensor 113Y, 113M, 113C and 113K, in step S14. In step S15, it is determined whether or not the image density B is lower than the predetermined image density (threshold Z2), and when it does not satisfy the condition, it is determined that the toner is not deteriorated, then in step 19, the frequency of the AC voltage is set to the setting value T2 which is the setting value when the toner is not deteriorated, then the process control ends. By contrast, when it satisfies the condition, the process proceeds to step S16, in step S16, the developing bias V is increased by the bias increment value of □V.

Next, in step S17, it is determined whether or not the developing bias that is raised by the □V is greater than the voltage set as the upper limit value of the developing bias.

When it does not satisfy the condition, the process returns to step 12, the image pattern is developed and the image density is measured again by the image density sensors 113K, 113Y, 113M and 113C. When it satisfies the condition, it is determined that the toner is deteriorated and the information of the toner deterioration is output, and in step S18, the frequency of the AC voltage is set to the setting value T3 which is the setting value when the toner is deteriorated and the frequency of the voltage output from the power supply 39 is increased, then the process control ends.

In the control flow described above, the control process is performed following the end of the known control successively, however, it may be performed at different timing from the existing process control, in consideration of the circumstances of the output condition.

Thus, if the toner is deteriorated, the number of periods of the voltage is changed depending on the deterioration degree of the toner. Accordingly, a high transfer performance in the recessed portions of the recording material P can be obtained when the toner is deteriorated similarly to a case when the toner is not deteriorated and it is possible to reduce the occurrence of the white spots so that image having a good quality can be obtained on the recording material P having a large irregularity similarly to that on the flat recording material.

In the toner deterioration control shown in FIGS. 43 and 44, the threshold values Z1, and Z2 are determined for determining the deterioration of the toner. Further, it is described using one setting value which is used when the toner deterioration is determined in each case. However, by setting multiple threshold values, multiple setting values corresponding to the respective threshold values may be set to use when it is determined that the toner is deteriorated.

Using such as multiple threshold values and the setting values, it becomes possible to determine the deterioration state of the toner precisely, and it becomes possible to change the number of periods of the voltage corresponding to the toner deterioration state appropriately. Accordingly, it is possible to obtain the image having a good quality on the recording material P having a large irregularity similarly to on the flat recording material.

In the above embodiment, the image density sensors 113K, 113Y, 113M, 113C, and the image density sensor 38 are employed as the toner deterioration detecting means. The toner deterioration determination means 70 determines the deterioration state of the toner automatically from these detection results, and the frequency of the secondary transfer bias (AC voltage) is changed depending on the results of determination. However, the present invention is not limited to this configuration, and the frequency of the secondary transfer bias may be changed manually by the operator.

Figure 45:
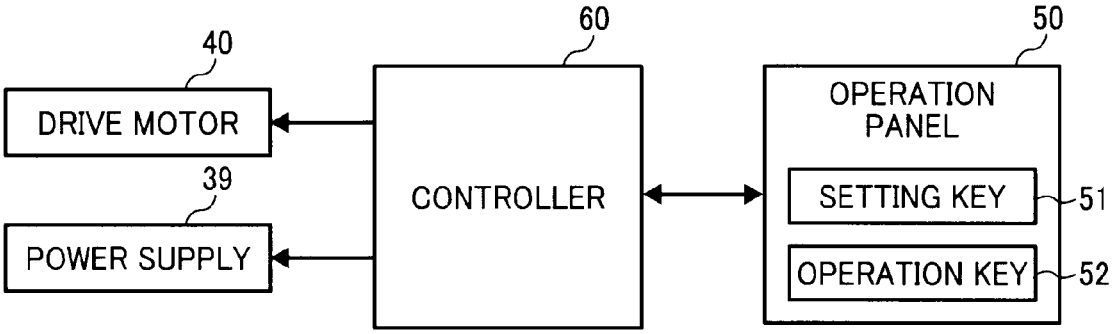
FIG. 45 is a block diagram showing another control system for changing the alternating electric field based on the toner deterioration determination.

There are experimental results of the relationship between the frequency of the secondary transfer bias (AC) and transfer performance, which is the relationship between the toner deterioration degree and the toner transfer performance as shown in Tables. 4 and 5. Accordingly, for example, as shown in Table. 6, assigning the frequency change modes to each relationship between the frequency and transfer performance in the recessed portions and, the experimental results are stored in the control unit 60 as shown in FIG. 45. In this case, the modes from 1 through 9 are assigned.

TABLE 6

| | Frequency (Hz) | | | | | | | | |
|---|---|---|---|---|---|---|---|---|---|
| | 400 | 600 | 800 | 1000 | 1200 | 1400 | 1600 | 1800 | 2000 |
| Transfer in recess portion | 3 | 3 | 4 | 4 | 5 | 5 | 5 | 5 | 5 |
| mode | 1 | 2 | 3 | 4 | 5 | 6 | 7 | 8 | 9 |

Figure 46:
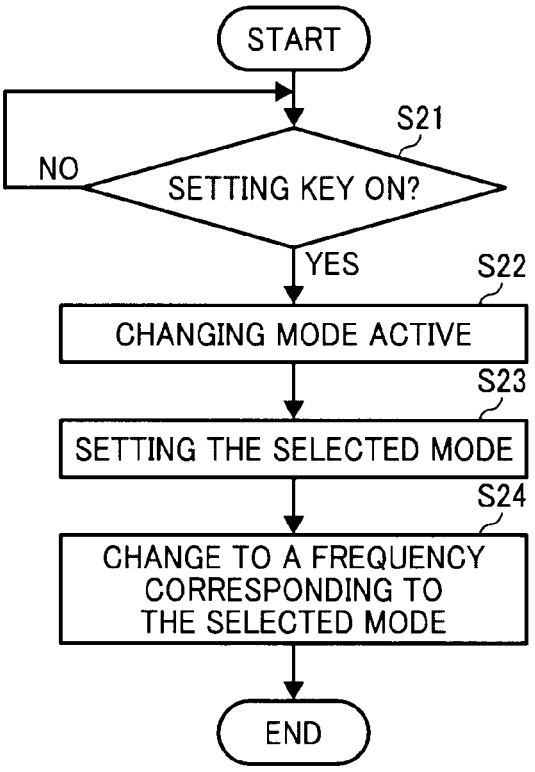
FIG. 46 is a flow chart showing steps in another control process for changing the alternating electric field based on the toner deterioration determination.

In this embodiment, the drive motor 40, the power supply 39, and the operation panel 50 are communicatively connected to the control unit 60, and for example, the operation panel 50 includes setting keys 51 to set frequency change mode and a switch 52 to perform the change operation. When the setting key 51 is operated, the control unit 60 makes the change mode active so that it is possible to execute the control according to the operation determined by the switch 52. For example, when the operator looks at the picture quality printed by the image forming operation and thinks that the image does not have sufficient quality and is needed to change the image quality level, the operator changes the setting keys 51. The control unit 60 determines the on/on status of the setting keys 51, in step S21 in FIG. 46.

When the setting key 51 is on, the operation of the key 52 is made active in step S22.

In step S23, when the mode 1 through 9 is selected by a key operation of an operator, the toner deterioration information is output. In step S24 the frequency is changed, for example, by controlling the power supply 39 and the drive motor 40 so that the frequency corresponding to the selected mode is obtained.

In this example, a mode 1 is set in the initial state, and it is possible to obtain a high quality print by selecting a high transfer mode when recording media P having large irregularity is selected.

If the frequency is changed by setting the setting key 51 and the operation key 52 manually, it is possible to obtain high quality prints according to the preference of the operator, and it is possible to remove the sensors for detecting the toner deterioration.

What is claimed is:

1. An image forming apparatus comprising:

a rotatable image carrier configured to carry a toner image developed with toner on a surface of the image carrier;

a rotatable transfer member configured to form a transfer nip by contacting the image carrier surface; and a power supply configured to output a voltage to transfer the toner image formed on the image carrier surface to a recording material captured in the transfer nip, wherein the voltage is switched alternately between a voltage in a transfer direction to transfer the toner image from the image carrier to the recording material and a voltage opposite to the voltage in the transfer direction when the toner image formed on the image carrier surface is transferred to the recording material, wherein a time average value (Vave) of the voltage has a polarity of the transfer direction to transfer the toner image from the image carrier to the recording material and is set to a value closer to a transfer voltage side, and wherein the image forming apparatus has a mode to change a cycle of the voltage output from the power supply based on toner information indicating a state of deterioration of the toner.

2. The image forming apparatus according to claim 1, wherein the cycle of the voltage when the toner information is present is set to a larger value than that when the toner information is not present.

3. The image forming apparatus according to claim 1, wherein the cycle of the voltage is changed by changing a frequency of the voltage output from the power supply.

4. The image forming apparatus according to claim 1, wherein the cycle of the voltage is changed by changing a processing linear velocity of the image forming apparatus.

5. The image forming apparatus according to claim 1, wherein when an output time of a voltage area in the transfer direction for a center voltage Voff is defined as "A", and an output time of the voltage in a direction reverse to the transfer direction for the center voltage Voff is defined as "B", it is set as A>B.

6. The image forming apparatus according to claim 1, wherein a time t1 of moving from a center voltage Voff to a peak voltage in the transfer direction is greater than a time moving from a peak voltage of a polarity opposite to the peak voltage in the transfer direction to the center voltage Voff.

7. The image forming apparatus according to claim 5, wherein the voltage is set to satisfy the relation $0.05<X<0.45$, where the voltage is X, and $X=B/(A+B)$.

8. The image forming apparatus according to claim 7, wherein the voltage is set to satisfy the relation $0.10<X<0.40$, where the voltage is $X=B/(A+B)$.

9. The image forming apparatus according to claim 1, wherein the power supply is configured to output a voltage by superimposing an AC component on a DC component, and the DC component is subjected to constant current control.

10. An image forming apparatus comprising:

a rotatable image carrier configured to carry a toner image developed with toner on a surface of the image carrier surface;

a rotatable transfer member configured to form a transfer nip by contacting the image carrier surface;

a power supply configured to output a voltage to the recording material captured in the transfer nip to transfer the toner image formed on the image carrier surface; and a toner status determination unit configured to determine whether or not the toner is deteriorated and output toner information including that the toner is deteriorated when the toner status determination unit determines that the toner is deteriorated, wherein the voltage switches alternately between a voltage in a transfer direction to transfer the toner image from the image carrier and a voltage opposite to the voltage in the transfer direction when the toner image formed on the image carrier surface is transferred to the recording material, wherein a time average value (Vave) of the voltage has a polarity of the transfer direction to transfer the toner image from the image carrier to the recording material and is set to a value closer to a transfer voltage side from an intermediate value (Voff) between maximum and minimum values, and wherein a cycle of the voltage output from the power supply can be changed based on the toner information from the toner status determination unit.

11. The image forming apparatus according to claim 10, wherein the toner status determination unit detects an image density of the toner image and determines that the toner is deteriorated when the detected value is below a predetermined threshold value.

12. The image forming apparatus according to claim 10, further comprising:

a latent image carrier configured to form a latent image;

an image forming unit configured to form a toner image on the latent image carrier; and a primary transfer unit configured to transfer the toner image on the latent image carrier to the latent image carrier, wherein the toner status determination unit detects a transfer rate by the primary transfer unit and determines whether or not the toner is deteriorated based on a change of the transfer rate.

13. A method of controlling an image forming apparatus having a power supply, the method comprising:

developing a toner image on a surface of a rotatable image carrier with toner;

forming a transfer nip by contacting a rotatable transfer member against the image carrier surface;

supplying recording material to the transfer nip;

outputting a voltage from the power supply to the recording material captured in the transfer nip to transfer the toner image formed on the image carrier surface to the recording material; and, changing a cycle of the voltage output from the power supply changed based on toner information indicating a state of deterioration of the toner, wherein the voltage alternates between a voltage in the transfer direction to transfer the toner image from the image carrier and a voltage opposite to the voltage in a transfer direction when the toner image formed on the image carrier surface is transferred to the recording material, wherein a time average value (Vave) of the voltage has a polarity of a transfer direction to transfer the toner image from the image carrier to the recording material and is set to a value closer to a transfer voltage side.

14. The method according to claim 13, further comprising:

determining whether or not the toner is deteriorated; and outputting toner information including that the toner is deteriorated when the determining step determines that the toner is deteriorated.

* * * * *